US009560456B2

(12) United States Patent
Banba et al.

(10) Patent No.: US 9,560,456 B2
(45) Date of Patent: Jan. 31, 2017

(54) HEARING AID AND METHOD OF DETECTING VIBRATION

(75) Inventors: Yutaka Banba, Kanagawa (JP); Takeo Kanamori, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 834 days.

(21) Appl. No.: 13/819,349

(22) PCT Filed: Feb. 21, 2012

(86) PCT No.: PCT/JP2012/001157
§ 371 (c)(1),
(2), (4) Date: Feb. 27, 2013

(87) PCT Pub. No.: WO2012/140818
PCT Pub. Date: Oct. 18, 2012

(65) Prior Publication Data

US 2013/0156208 A1 Jun. 20, 2013

(30) Foreign Application Priority Data

Apr. 11, 2011 (JP) ..... 2011-087399

(51) Int. Cl.
*H04R 25/00* (2006.01)
*G10L 21/0208* (2013.01)
*G10L 21/0216* (2013.01)

(52) U.S. Cl.
CPC ..... *H04R 25/30* (2013.01); *G10L 21/0208* (2013.01); *H04R 25/407* (2013.01); *G10L 2021/02165* (2013.01); *H04R 2430/03* (2013.01)

(58) Field of Classification Search
CPC ..... H04R 25/407; H04R 3/005; H04R 25/552; H04R 2430/20; H04R 1/1083; H04R 2410/07; H04R 25/505; H04R 1/406; H04R 2225/43; H04R 25/453; H04R 25/50; H04R 29/004; H04R 3/04; H04R 1/08; H04R 2225/41; H04R 2430/03; H04R 2430/02; H04R 25/30; G10L 21/0208; G10L 2021/02165
(Continued)

(56) References Cited

U.S. PATENT DOCUMENTS

2009/0067651 A1 3/2009 Klinkby et al.
2010/0026858 A1 2/2010 Kanamori
(Continued)

FOREIGN PATENT DOCUMENTS

JP 08-116596 5/1996
JP 08-163700 6/1996
(Continued)

OTHER PUBLICATIONS

International Search Report issued Apr. 3, 2012 in International (PCT) Application No. PCT/JP2012/001157.

*Primary Examiner* — Davetta W Goins
*Assistant Examiner* — Phylesha Dabney
(74) *Attorney, Agent, or Firm* — Wenderoth, Lind & Ponack, L.L.P.

(57) ABSTRACT

A hearing aid capable of detecting contact vibration noise from a collected sound signal. The hearing aid is provided with two microphones, a vibration component extracting section that extracts from collected sound signals respectively obtained by the two microphones an uncorrelated component between two collected sound signals as a vibration component for each frequency band. Additionally, a vibration noise identifying section determines whether or not a contact noise occurs based on the vibration component for each frequency band extracted by the vibration compo-
(Continued)

nent extracting section, an acoustic signal processing section, when generating an acoustic signal by hearing aid processing of the two collected sound signals, processes the acoustic signal depending on the presence or absence of the occurrence of the contact vibration noise, and a receiver converts the acoustic signal to sound.

10 Claims, 18 Drawing Sheets

(58) Field of Classification Search
USPC ..... 381/92, 97, 313, 317, 318; 348/241
See application file for complete search history.

(56) References Cited

U.S. PATENT DOCUMENTS

| | | | | |
|---|---|---|---|---|
| 2010/0172506 | A1 | 7/2010 | Iwano | |
| 2011/0135128 | A1 | 6/2011 | Ura | |
| 2012/0008797 | A1* | 1/2012 | Banba ..... | H04R 3/007 381/97 |
| 2012/0008807 | A1 | 1/2012 | Gran | |

FOREIGN PATENT DOCUMENTS

| | | |
|---|---|---|
| JP | 2009-105527 | 5/2009 |
| JP | 2009-532924 | 9/2009 |
| JP | 2010-154432 | 7/2010 |
| JP | 2011-139462 | 7/2011 |
| WO | 2009/044562 | 4/2009 |
| WO | 2009/156906 | 12/2009 |
| WO | 2010/004769 | 1/2010 |

* cited by examiner

HEARING AID AND METHOD OF DETECTING VIBRATION

TECHNICAL FIELD

The present invention relates to a hearing aid and a method of detecting vibration having two microphones.

BACKGROUND ART

When a hearing aid is placed in and removed from the ear, feedback noise can occur. This is because of a large change in the acoustic transfer function (hereinafter "acoustic system") between the microphone collecting sound and the receiver outputting sound.

Art for feedback noise suppression control in a hearing aid is disclosed, for example, by Patent Literature 1 and Patent Literature 2.

In the art in Patent Literature 1, in a case where the state in which the level of a particular frequency signal is prominent in the collected sound signal from the microphone continues, feedback noise is judged to have occurred, and the volume of the acoustic signal is reduced. In the art in Patent Literature 2, a touch sensor by electrodes is provided in a hearing aid, and the timing of the placing in or removing from the ear of the hearing aid is detected by the existence or non-existence of contact with the skin, at which time the volume of the acoustic signal is reduced.

According to the above-noted conventional art, feedback noise caused by placement in and removal from the ear can be reduced or prevented.

CITATION LIST

Patent Literature

PTL 1
Japanese Patent Application Laid-Open No. 2009-105527
PTL 2
Japanese Patent Application Laid-Open No. HEI 8-163700

SUMMARY OF INVENTION

However, because the art disclosed in Patent Literature 1 cannot detect feedback noise unless the feedback noise continues at some level or greater, it is difficult to suppress the first part of the feedback noise. Also, the art disclosed in Patent Literature 2 requires the provision of a new sensor called a touch sensor in addition to the microphone, thereby presenting an obstacle to the achievement of compactness, light weight, and energy efficiency necessary in a hearing aid.

When placing and removing a hearing aid, vibration occurring by the contact of the outside of the hearing aid enclosure with the hand or ear (hereinafter "contact vibration") is transmitted to the microphone as a solid-propagated sound, is superimposed as noise onto the collected sound signal, and is the cause of feedback noise. If noise caused by contact vibration (hereinafter "contact vibration noise") can be detected from the collected sound signal, it is possible to predict the large change in the acoustic system with high accuracy.

That is, the detection and suppression of contact vibration noise can suppress feedback noise from the start thereof, without providing a new sensor. In a hearing aid, therefore, it is desirable to detect and suppress the contact vibration noise from the collected sound signal.

An object of the present invention is to provide a hearing aid and a method of detecting vibration capable of detecting contact vibration noise from the collected sound signal.

A hearing aid according to the present invention has: two microphones; a vibration component extracting section that, from the collected sound signals obtained by each of the two microphones, extracts non-correlated components between the two collected sound signals as frequency band specific vibration components; a vibration noise identifying section that, based on the frequency band specific vibration components extracted by the vibration component extracting section, judges whether or not contact vibration noise has occurred; an acoustic signal processing section that, when performing hearing aid processing of the two collected sound signals and generating an acoustic signal, performs processing of the acoustic signal in accordance with the occurrence or non-occurrence of contact vibration noise; and a receiver that converts the acoustic signal to sound.

A method of detecting vibration according to the present invention is a method of detecting vibration in a hearing aid having two microphones, and has: a step of extracting from collected sound signals obtained by the two microphones non-correlated components between the two collected sound signals as frequency band specific vibration components; a step of judging, based on the extracted frequency band specific vibration components, whether or not contact vibration noise has occurred; and a step, when performing hearing aid processing of the two collected sound signal and generating an acoustic signal, of performing processing of the acoustic signal in accordance with the occurrence or non-occurrence of contact vibration noise.

The present invention can detect contact vibration noise from a collected sound signal.

DESCRIPTION OF EMBODIMENTS

Embodiments of the present invention will now be described in detail, with reference to the accompanying drawings. Embodiment 1 of the present invention is an example of the base aspect of the present invention, and Embodiment 2 to Embodiment 5 are specific aspects of the present invention.

In the following embodiments, the sound included in the collected sound signal in the hearing aid is generally divided between air-propagated sound and solid-propagated sound.

Air-propagated sound is sound that is propagated to the microphone of the hearing aid via air as the medium, for example, the speech sound of a person with whom the user wearing the hearing aid is conversing.

Solid-propagated sound is sound that is propagated to the microphone of the hearing aid via a solid, including the hearing aid itself, as the medium.

In the present embodiment, the component of the air-propagated sound in the collected sound signal will be referred to as the "sound component" and the component of the solid-propagated sound in the collected sound signal will be referred to as the "vibration component".

The solid-propagated sound is classified into the speech sound from the user him/herself (hereinafter "self-talk"), and sound by contact vibration accompanying contact with the hearing aid enclosure by the hand when putting on and removing the hearing aid. That is, the vibration component is classified into the part attributed to self-talk (hereinafter "self-talk noise") and that attributed to contact vibration noise.

Embodiment 1

A hearing aid according to Embodiment 1 of the present invention is an example that is applied to a behind-the-ear hearing aid, which is worn at either the right or the left ear of the user, collects sounds, and amplifies a voice by performing prescribed processing to output it to an ear hole of the user. The various parts of the acoustic processing apparatus described below are implemented, for example, by hardware, such as microphone disposed within the hearing aid, a receiver, a CPU (central processing unit), and a storage medium such as a ROM (read only memory) in which a control program is stored.

Figure 1:
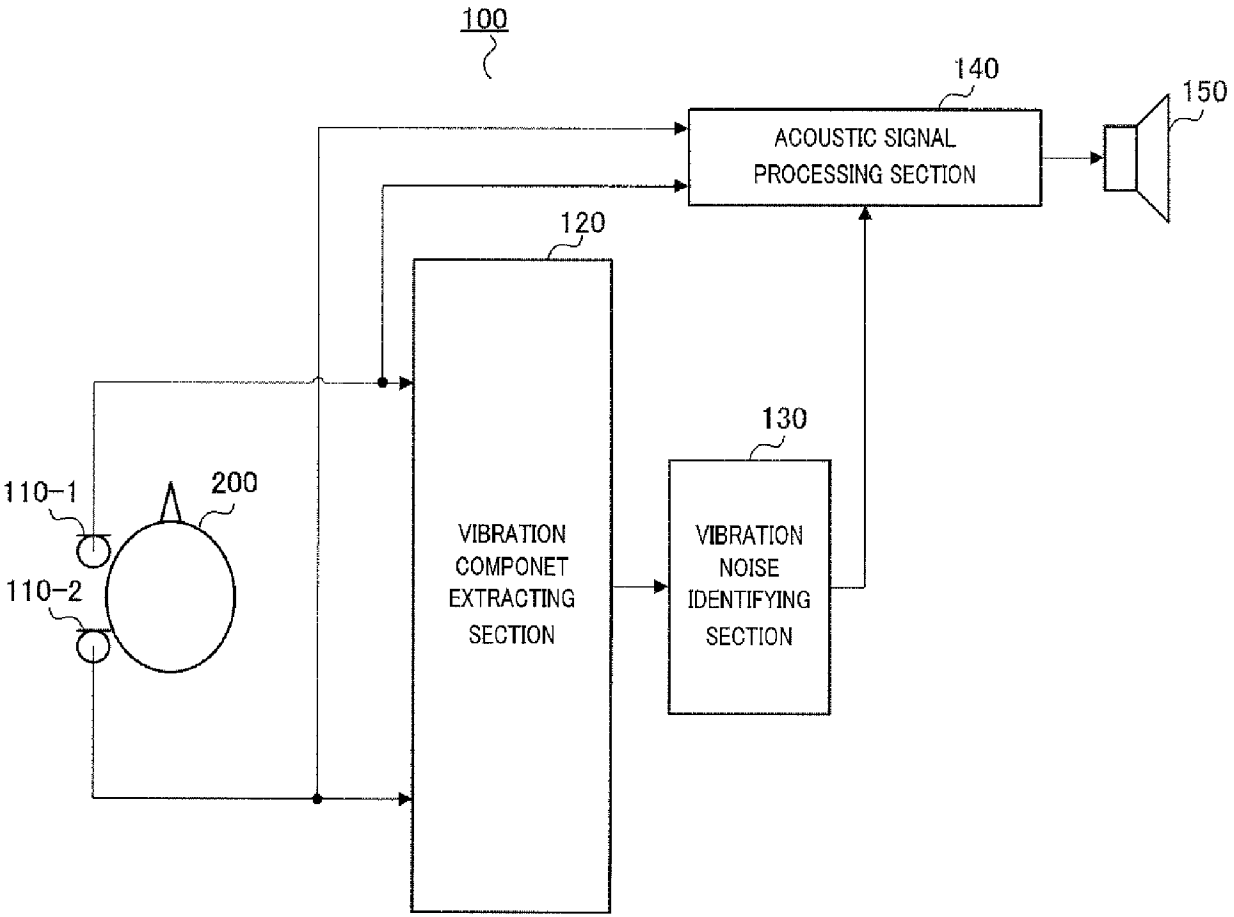
FIG. 1 is a block diagram showing the configuration of a hearing aid according to Embodiment 1 of the present invention.

FIG. 1 is a block diagram showing the configuration of a hearing aid according to the present embodiment.

In FIG. 1, hearing aid 100 has first and second microphones 110-1 and 110-2 (two microphones 110), vibration component extracting section 120, vibration noise identifying section 130, acoustic signal processing section 140, and receiver 150.

First and second microphones 110-1 and 110-2 are disposed at different positions within hearing aid 100, and each collects sound to obtain a collected sound signal.

Vibration component extracting section 120 extracts components having a low correlation between the two collected sound signals (hereinafter "non-correlated components") as frequency band specific vibration components from each of the collected sound signals obtained by the first and second microphones 110-1 and 110-2. The non-correlated components are components other than air-propagated components, and are mainly vibration components that directly drive the diaphragm of microphones 110, or thermal noise components that are characteristic to microphones 110. Because the level of thermal noise components is low, non-correlated components equal to or greater than a certain level are substantially equal to the vibration components.

Vibration noise identifying section 130 judges whether or not contact vibration noise has occurred, based on the frequency band specific vibration components extracted by vibration component extracting section 120. For example, if only low-frequency band vibration components of the frequency band specific vibration components are detected, vibration noise identifying section 130 identifies these vibration components as self-talk noise, distinguished from contact vibration noise. Also, for example, vibration noise identifying section 130, using the condition that the level of the high-frequency band vibration components is relatively high with respect to the level of the low-frequency band vibration components, judges that contact vibration noise has occurred.

When performing hearing aid processing of the two collected sound signals to generate an acoustic signal, acoustic signal processing section 140 processes an acoustic signal in accordance with the occurrence or non-occurrence of contact vibration noise. Acoustic signal processing section 140, for example, controls the volume of the acoustic signal in accordance with the occurrence or non-occurrence of contact vibration noise.

Receiver 150 converts the acoustic signal to sound.

As described above, because the positions of first and second microphones 110-1 and 110-2 are different, the correlation between the vibration components of the two collected sound signals is lower than the correlation between sound components of the two collected sound signals. Therefore, hearing aid 100, by extracting non-correlated components between the two collected sound signals, can extract vibration components of the collected sound signals with good accuracy.

The level of the high-frequency band of the self-talk noise of user 200 is extremely low compared to the level of the high-frequency band of the contact vibration noise. Therefore, hearing aid 100, based on the relative size of the level of the high-frequency band of the vibration component with respect to the level of the low-frequency band of the vibration component, can identify the vibration component with good accuracy. Specifically, hearing aid 100 can distinguish the vibration components between self-talk noise and contact vibration noise (hereinafter collective referred to as "noise").

That is, because hearing aid 100 of the present embodiment extracts non-correlated components between the collected sound signals as vibration components, and identifies noise based on the level of the high-frequency band thereof, it can detect contact vibration noise from the collected sound signals. That is, hearing aid 100 of the present embodiment, by detecting contact vibration noise at the initial stage of the occurrence, can prevent feedback noise.

Embodiment 2

A hearing aid according to Embodiment 2 of the present invention is an example that is applied to a behind-the-ear hearing aid that performs hearing aid processing and processing for feedback noise suppression.

More specifically, the hearing aid of the present embodiment extracts frequency band specific vibration components from the collected sound signals and distinguishes between self-talk noise and contact vibration noise. When hearing aid of the present embodiment detects contact vibration noise, the hearing aid estimates that the hearing aid has been put on to and removed from the ear and that feedback noise will occur due to the change in the acoustic system, and performs processing for feedback noise suppression.

The various parts of the acoustic processing apparatus described below are implemented, for example, by hardware, such as microphone disposed within the hearing aid, a receiver, a CPU, and a storage medium such as a ROM in which a control program is stored.

The configuration of the hearing aid of the present embodiment will first be described.

Figure 2:
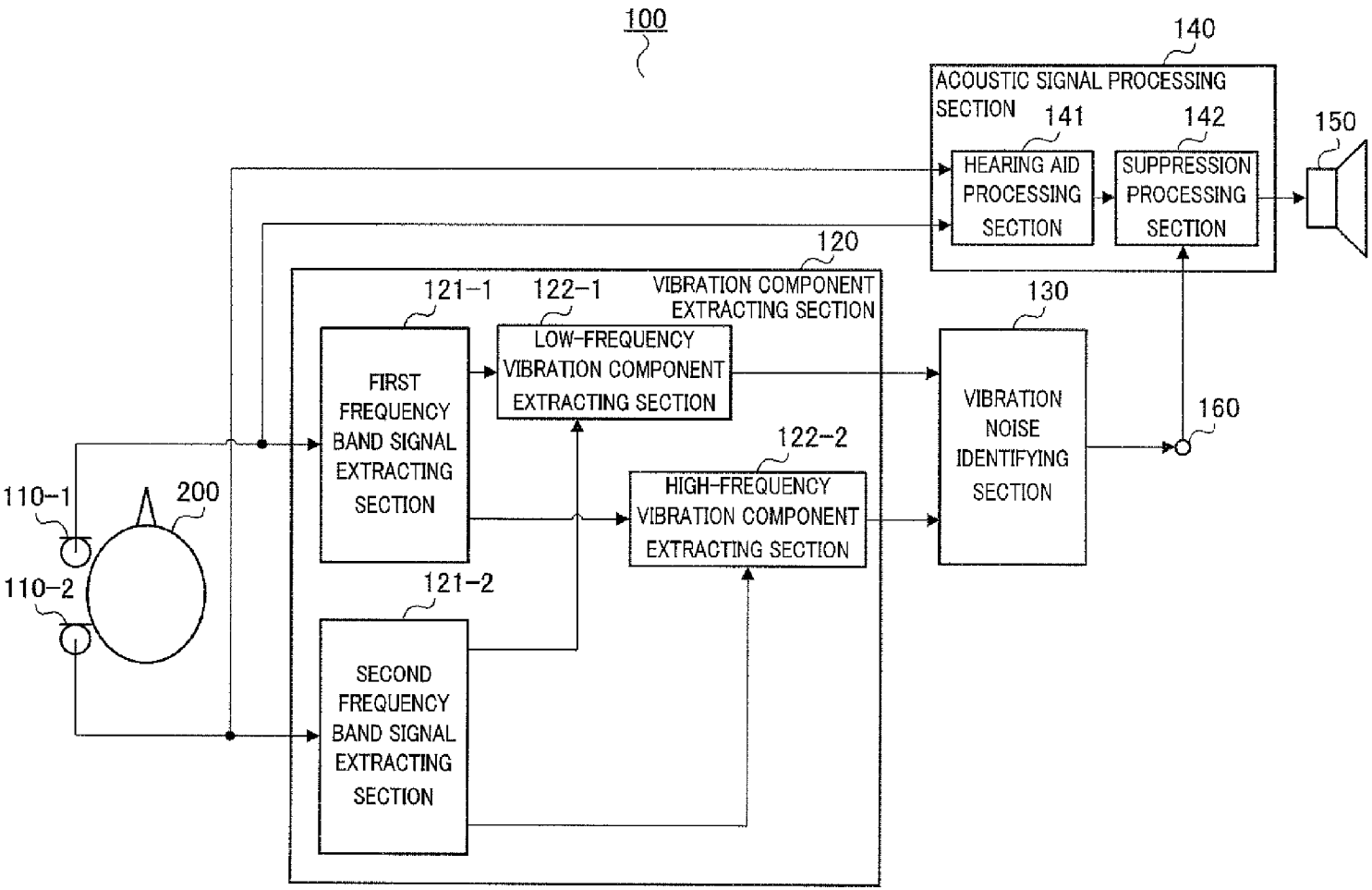
FIG. 2 is a block diagram showing the configuration of a hearing aid according to Embodiment 2 of the present invention.

FIG. 2 is a block diagram showing the configuration of a hearing aid according to the present embodiment.

In FIG. 2, hearing aid 100 has first and second microphones 110-1 and 110-2 (two microphones 110), vibration component extracting section 120, vibration noise identifying section 130, acoustic signal processing section 140, and receiver 150.

First and second microphones 110-1 and 110-2 are disposed at different positions within hearing aid 100, and each collects sound to obtain a collected sound signal. First microphone 110-1 outputs the obtained collected sound signal (hereinafter "first collected sound signal") to vibration component extracting section 120 and acoustic signal processing section 140. Second microphone 110-2 outputs the obtained collected sound signal (hereinafter "second collected sound signal") to vibration component extracting section 120 and acoustic signal processing section 140.

Figure 3:
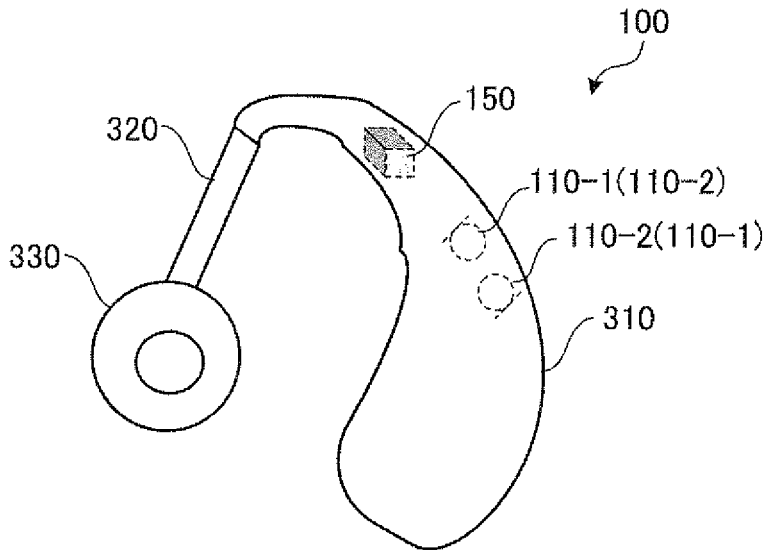
FIG. 3 is a drawing showing an example of the outer appearance of a hearing aid according to Embodiment 2 of the present invention.

FIG. 3 shows an example of the outer appearance of the hearing aid.

As shown in FIG. 3, hearing aid 100 has hearing aid main unit 310, acoustic tube 320, and ear tip 330. Hearing aid main unit 310 is hung over the pinna. With the hearing aid main unit 310 hung over the pinna, ear tip 330 is fitted into the ear hole.

First microphone 110-1 and second microphone 110-2 are housed within hearing aid main unit 310 of hearing aid 100, and are omni-directional microphones. First microphone 110-1 and second microphone 110-2 collect surrounding sound via a hole such as a slit.

Receiver 150, which is described later, is a speaker housed within hearing aid main unit 310 of hearing aid 100. Sound which is emitted from receiver 150 passes through acoustic tube 320 and output from ear tip 330 to within the ear hole.

Hearing aids provided with two omni-directional microphones in this manner are widely used. This is because it is possible to synthesize directivity of a voice from the two collected sound signals, and output an acoustic signal having directivity with a simple, inexpensive apparatus.

Figure 4:
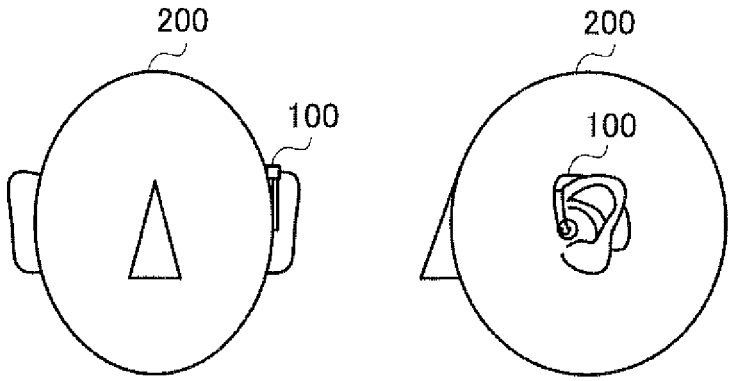
FIG. 4 is a drawing showing the condition in which the hearing aid according to Embodiment 2 of the present invention is worn.

FIG. 4 shows the condition of the hearing aid when worn.

As shown in FIG. 4, hearing aid 100 is, for example, hung over the left ear of user 200, and is fixed to the left side of the head of user 200.

Vibration component extracting section 120, from the collected sound signals obtained by each of the first and second microphones 110-1 and 110-2, extracts low-correlation components (hereinafter "non-correlated components") between the two collected sound signals as frequency band specific vibration components. An example in which vibration components are extracted as frequency band specific vibration components in two frequency bands of a high-frequency vibration component and a low-frequency vibration component will now be described.

Vibration extracting section 120 extracts frequency band specific signal components and vibration components. Vibration extracting section 120 has first frequency band signal extracting section 121-1 and second frequency band signal extracting section 121-2 (frequency band signal extracting sections), and low-frequency vibration component extracting section 122-1 and high-frequency vibration component extracting section 122-2 (vibration component extracting sections).

Frequency band signal extracting section 120, shown in FIG. 2, extracts a low-frequency band signal and a high-frequency band signal from each of the two collected sound signals of first and second microphones 110-1 and 110-2.

In this case, the low-frequency band (hereinafter sometimes referred to as "low band") is a band that includes the self-talk vibration components and the contact vibration component, for example, a band that is approximately 1 kHz and below. The high-frequency band (hereinafter sometimes referred to as "high band") is a band that includes contact vibration components and does not include self-talk vibration components, for example, a band exceeding approximately 1 kHz.

First frequency band signal extracting section 121-1 extracts a low-frequency band signal from the first collected sound signal and outputs the extracted signal (hereinafter "first low-band signal") to low-frequency vibration component extracting section 122-1. Also, first frequency band signal extracting section 121-1 extracts a high-frequency band signal from the first collected sound signal and outputs the extracted signal (hereinafter "first high-band signal") to high-frequency vibration component extracting section 122-2.

Second frequency band signal extracting section 121-2 extracts a low-frequency band signal from the second collected sound signal and outputs the extracted signal (hereinafter, "second low-band signal") to low-frequency vibration component extracting section 122-1. Also, second frequency band signal extracting section 121-2 extracts a high-frequency band signal from the second collected sound signal and outputs the extracted signal (hereinafter, "second high-band signal") to high-frequency vibration component extracting section 122-2.

First frequency band signal extracting section 121-1 and second frequency band signal extracting section 121-2 have, for example, the same configuration.

Figure 5:
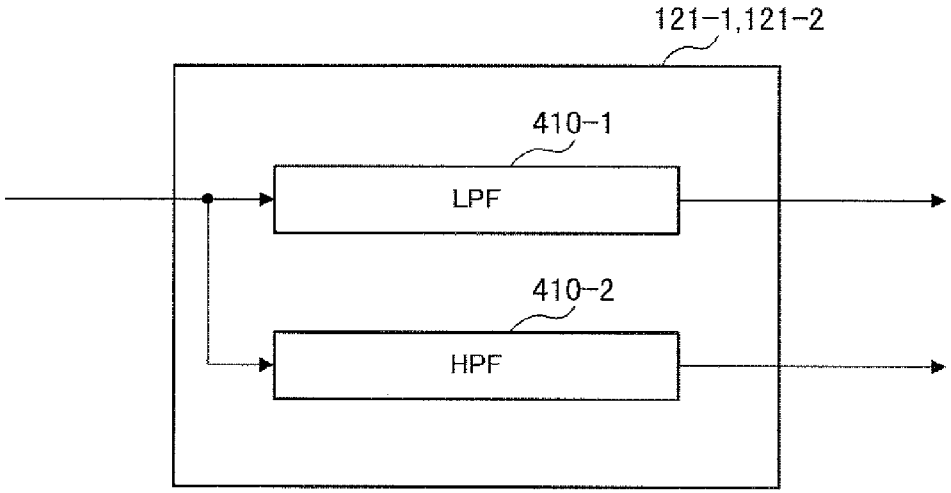
FIG. 5 is a block diagram showing an example of the configuration of first and second frequency band signal extracting sections in Embodiment 2 of the present invention.

FIG. 5 is a block diagram showing an example of the configuration of first and second frequency band signal extracting sections 121-1 and 121-2.

As shown in FIG. 5, first and second frequency band signal extracting sections 121-1 and 121-2 have, for example, two bandpass filters having different passbands. Specifically, first frequency band signal extracting section 121-1 has lowpass filter (LPF) 410-1 and highpass filter (HPF) 410-2. Also, second frequency band signal extracting section 121-2 has lowpass filter (LPF) 410-1 and highpass filter (HPF) 410-2.

Lowpass filter 410-1 passes and outputs, as the first low-band signal (or second low-band signal), only low-frequency band components of the first collected sound signal (or second collected sound signal).

Highpass filter 410-2 passes and outputs, as the first high-band signal (or second high-band signal), only high-frequency band components of the first collected sound signal (or second collected sound signal).

First and second frequency band signal extracting sections 121-1 and 121-2 may extract a low-band signal and a high-band signal by an FFT (fast Fourier transform) that converts a time waveform to a frequency spectrum.

Low-frequency vibration component extracting section 122-1 of FIG. 2 extracts a low-frequency vibration component from the first low-band signal and the second low-band signal. Additionally, low-frequency vibration component extracting section 122-1 outputs to vibration noise identifying section 130 a signal (hereinafter "low-frequency vibration component level signal") indicating the level of the extracted vibration component (hereinafter "low-frequency vibration component").

More specifically, low-frequency vibration component extracting section 122-1 first calculates a signal indicating the level of the first low-band signal (hereinafter, "first low-band level signal") and a signal indicating the level of the second low-band signal (hereinafter "second low-band level signal").

In the present embodiment, the first low-band level signal is a signal that is the smoothed square value of the first low-band signal, and the second low-band level signal is a signal that is the smoothed square value of the second low-band signal.

Low-frequency vibration component extracting section 122-1 extracts, as the low-frequency vibration component, a non-correlated component between the first low-band level signal and the second low-band level signal.

High-frequency vibration component extracting section 122-2 extracts a high-frequency vibration component from the first high-band signal and the second high-band signal. Additionally, high-frequency vibration component extracting section 122-2 outputs to vibration noise identifying section 130 a signal (hereinafter "high-frequency vibration component level signal) indicating the level of the extracted vibration component (hereinafter "high-frequency vibration component").

More specifically, high-frequency vibration component extracting section 122-2 first calculates a signal indicating the level of the first high-band signal (hereinafter, "first high-band level signal") and a signal indicating the level of the second high-band signal (hereinafter "second high-band level signal").

In the present embodiment, the first high-band level signal is a signal that is the smoothed square value of the first high-band signal, and the second high-band level signal is a signal that is the smoothed square value of the second high-band signal.

High-frequency vibration component extracting section 122-2 extracts, as the high-frequency vibration component, a non-correlated component between the first high-band level signal and the second high-band level signal.

Air-propagated sound has a high correlation between first and second microphones 110-1 and 110-2. Solid-propagated sound has a low correlation between first and second microphones 110-1 and 110-2. That is focusing on the difference in correlation between air-propagated sound and solid-propagated sound (vibration noise), low-frequency vibration component extracting section 122-1 and high-frequency vibration component extracting section 122-2 extract each vibration noise.

Although low-frequency vibration component extracting section 122-1 and high-frequency vibration component extracting section 122-2 have different frequency band signals input thereto, they have the same configuration.

Figure 6:
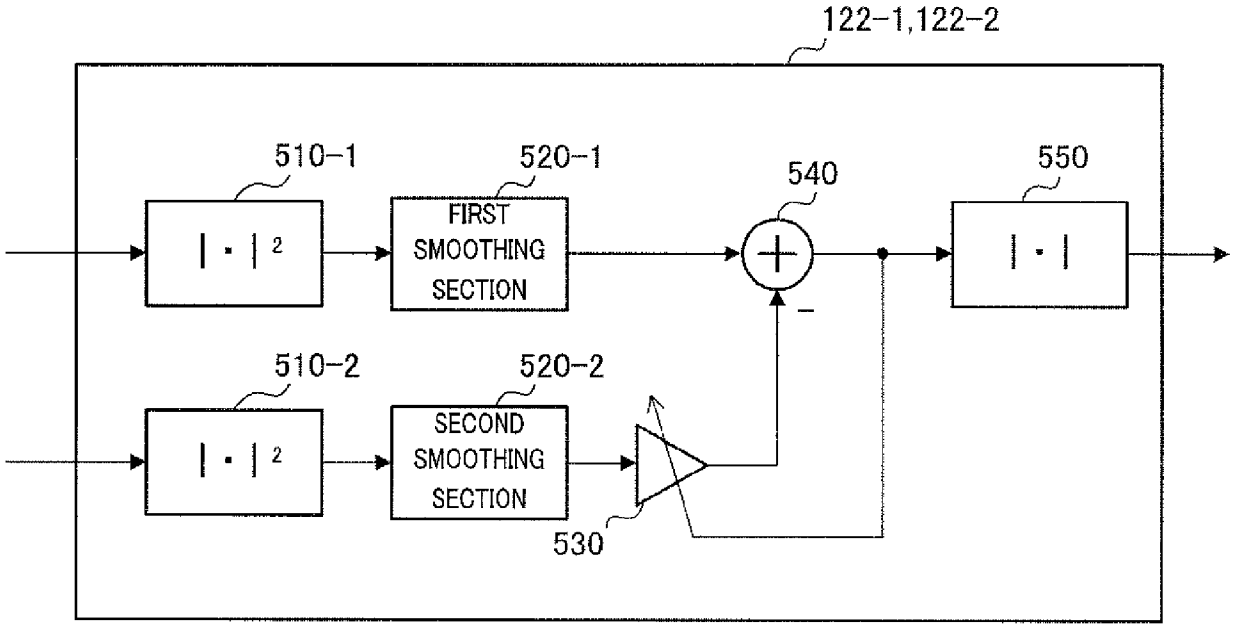
FIG. 6 is a block diagram showing an example of the configuration of a low-frequency vibration component extracting section and a high-frequency vibration component extracting section according to Embodiment 2 of the present invention.

FIG. 6 is a block diagram showing an example of the configuration of low-frequency vibration component extracting and high-frequency vibration component extracting sections 122-1 and 122-2.

As shown in FIG. 6, low-frequency vibration component extracting and high-frequency vibration component extracting sections 122-1 and 122-2 each have first square value calculating section 510-1, second square value calculating section 510-2, first smoothing section 520-1, second smoothing section 520-2, variable multiplier (amplitude correction multiplier) 530, adder 540, and absolute value calculating section 550.

First square value calculating section 510-1 outputs to first smoothing section 520-1 a signal indicating the squared value of the first low-band signal (or first high-band signal).

Second square value calculating section 510-2 outputs to second smoothing section 520-2 a signal indicating the squared value of the second low-band signal (or second high-band signal).

First smoothing section 520-1 by, for example, a lowpass filter, smoothes a signal indicating the square value of the first low-band signal (or first high-band signal) and outputs the result to adder 540 as the first low-band level signal (or first high-band level signal).

Second smoothing section 520-2 by, for example, a lowpass filter, smoothes a signal indicating the square value of the second low-band signal (or second high-band signal) and outputs the result to variable multiplier 530 as the second low-band level signal (or second high-band level signal).

The time constant in the smoothing is set to a value so as to moderate the effect of the difference in arrival times of air-propagated sound due to the spacing between first microphone 110-1 and second microphone 110-2 lowering the correlation between the signals. Furthermore, the time constant in the smoothing is set to an appropriate value that, in adder 540 that is the following stage, the air-propagated sound is preferably canceled.

Variable multiplier 530 determines a correction multiplier from the difference value that is the output of adder 540, and multiplies the second low-band level signal (or second high-band level signal) by the determined correction multiplier. Variable multiplier 530 then outputs to adder 540 the signal obtained by multiplying the second low-band level signal (or second high-band level signal) by the correction multiplier.

Adder 540 outputs, to absolute value calculating section 550 and variable multiplier 530, a difference signal between the first low-band level signal (or first high-band level signal) and the second low-band level signal (or second high-band level signal) that has been amplitude-corrected by multiplication by the correction multiplier. The output signal of adder 540 indicates non-correlated components between the first low-band level signal (or first high-band level signal) and the second low-band level signal (or second high-band level signal) (i.e., non-correlated component for each band).

Variable multiplier 530 and adder 540 calculate the correction multiplier from the difference signal of adder 540, and multiply the second low-band level signal (or second high-band level signal) by the correction multiplier to perform sound pressure sensitivity correction. By doing this, variable multiplier 530 and adder 540 extract the non-correlated component in the low-frequency band (or high-frequency band). This sound pressure sensitivity correction includes correction for variations in the sensitivity of first and second microphones 110-1 and 110-2 caused by the manufacturing process and the like.

The sound pressure sensitivity correction also includes correction for sensitivity variation caused by the occurrence of difference in the acoustic paths between first and second microphones 110-1 and 110-2 because of the effect of the ear or the like. By this sound pressure sensitivity correction, air-propagated sound components that are included in a high amount in the first and second collected sound signals and that have a high correlation are appropriately cancelled, enabling extraction of non-correlated components.

In adder 540, the sign of the second low-band level signal (or second high-band level signal) is reversed. Variable multiplier 530 updates the correction multiplier (variable multiplier) so that this difference signal value approaches zero.

If the difference signal is negative, the smoothed second low-band level signal (second high-band level signal) is larger than the smoothed first low-band level signal (first high-band level signal). Therefore, variable multiplier 530, for example, reduces the gain (correction multiplier).

On the other hand, if the difference signal is positive, the smoothed second low-band level signal (second high-band level signal) is smaller than the smoothed first low-band level signal (first high-band level signal).

Therefore, variable multiplier 530, for example, increases the gain (correction multiplier). By doing this, using air-propagated sound that has a high correlation between microphones 110 and that is collected in usual use, sound pressure sensitivity correction between microphones 110 is possible. By doing this, it is possible to extract only non-correlated components.

Absolute value calculating section 550 calculates and outputs a signal indicating the absolute value of non-correlated components for each band as the low-frequency vibration component level signal (or high-frequency vibration component level signal).

Vibration noise identifying section 130, using the condition that the level of the high-frequency band vibration components is relatively high with respect to the level of the low-frequency band vibration components, judges that contact vibration noise has occurred. Vibration noise identifying section 130 outputs the result of the identification to acoustic signal processing section 140 via output section 160.

More specifically, vibration noise identifying section 130 judges that contact vibration noise has occurred, using the condition that the ratio of the level of the high-frequency band vibration components with respect to the level of the low-frequency band vibration components exceeds a prescribed threshold. If vibration noise identifying section 130 judges that contact vibration noise has occurred, it judges that feedback noise has occurred due to a change in the acoustic system, and instructs acoustic signal processing section 140 to execute prescribed processing for feedback noise suppression.

When performing hearing aid processing of two collected sound signals and generating an acoustic signal, acoustic signal processing section 140 performs the processing for the acoustic signal in accordance with the occurrence or non-occurrence of contact vibration noise. Acoustic signal processing section 140 includes hearing aid processing section 141 and suppression processing section 142.

Hearing aid processing section 141 performs prescribed hearing aid processing such as amplification from the first collected sound signal and second collected sound signal, generates an acoustic signal, and outputs the generated acoustic signal to suppression processing section 142.

Suppression processing section 142 transfers the acoustic signal to receiver 150. When there is an instruction from vibration noise identifying section 130, suppression processing section 142 executes prescribed processing with respect to the acoustic signal for suppression of feedback noise.

Receiver 150 converts the acoustic signal subjected to hearing aid processing to sound, and outputs the result as a hearing aid sound.

Self-talk, because of the nature of speech, intrinsically has a small amount of energy in the band of 1 kHz and above. Of the self-talk, vibration components that are transferred to microphones 110 are centered on a band of 1 kHz and below, because of the effect of bone conduction.

In contrast, because the vibration components of contact vibration are pulse-like vibration noise, they are distributed over a broad frequency band, ranging from several hertz to above 1 kHz.

For this reason, if vibration noise exists only in the low band, the vibration noise is self-talk noise. Also, if vibration noise exists in the high band as well as in the low band, the vibration noise is contact vibration noise. Therefore, by taking the band of approximately 1 kHz and below to be the low band and the band exceeding approximately 1 kHz to be the high band and analyzing the vibration components in each of the bands as described above, hearing aid 100 can distinguish between self-talk noise and contact vibration noise. Specifically, if, of the frequency band specific vibration components, only low-frequency vibration components are detected in vibration noise identifying section 130, hearing aid 100 can distinguish the vibration components as self-talk noise from contact vibration noise.

Even in the case of air-propagated sound, however, the high-band signal having a short wavelength tends to be influenced by the head and unevenness of the pinna, which constitute the environment surrounding the hearing aid, and influenced by the phase difference due to the microphone positions. For this reason, in the non-correlated component extraction, even by taking the difference between the first and second high-band level signals, components other than vibration components might be erroneously output as a high-band vibration level signal.

Given the above, hearing aid 100 distinguishes contact vibration noise not simply by the occurrence or non-occurrence of high-band vibration noise, but rather based on whether the vibration noise level being high and also the level of the high-band vibration noise being relatively high with respect to the level of the low-band vibration noise. In other words, hearing aid 100 distinguishes vibration noise by a procedure of detecting low-band vibration level that is included in both the contact vibration noise and self-talk noise, and then detecting the high-band vibration level.

Because hearing aid 100 such as noted above extracts non-correlated components between collected sound signals as vibration components and distinguishes noise based on the level of the high-frequency band thereof, hearing aid 100 can detect contact vibration noise from the collected sound signals. Also, because hearing aid 100, in addition to the usual hearing aid processing, processes an acoustic signal for suppression of feedback noise when contact vibration noise is detected, it is possible to reduce feedback noise.

The above completes the description of the configuration of a hearing aid according to the present embodiment.

Next, the operation of hearing aid 100 will be described.

Figure 7:
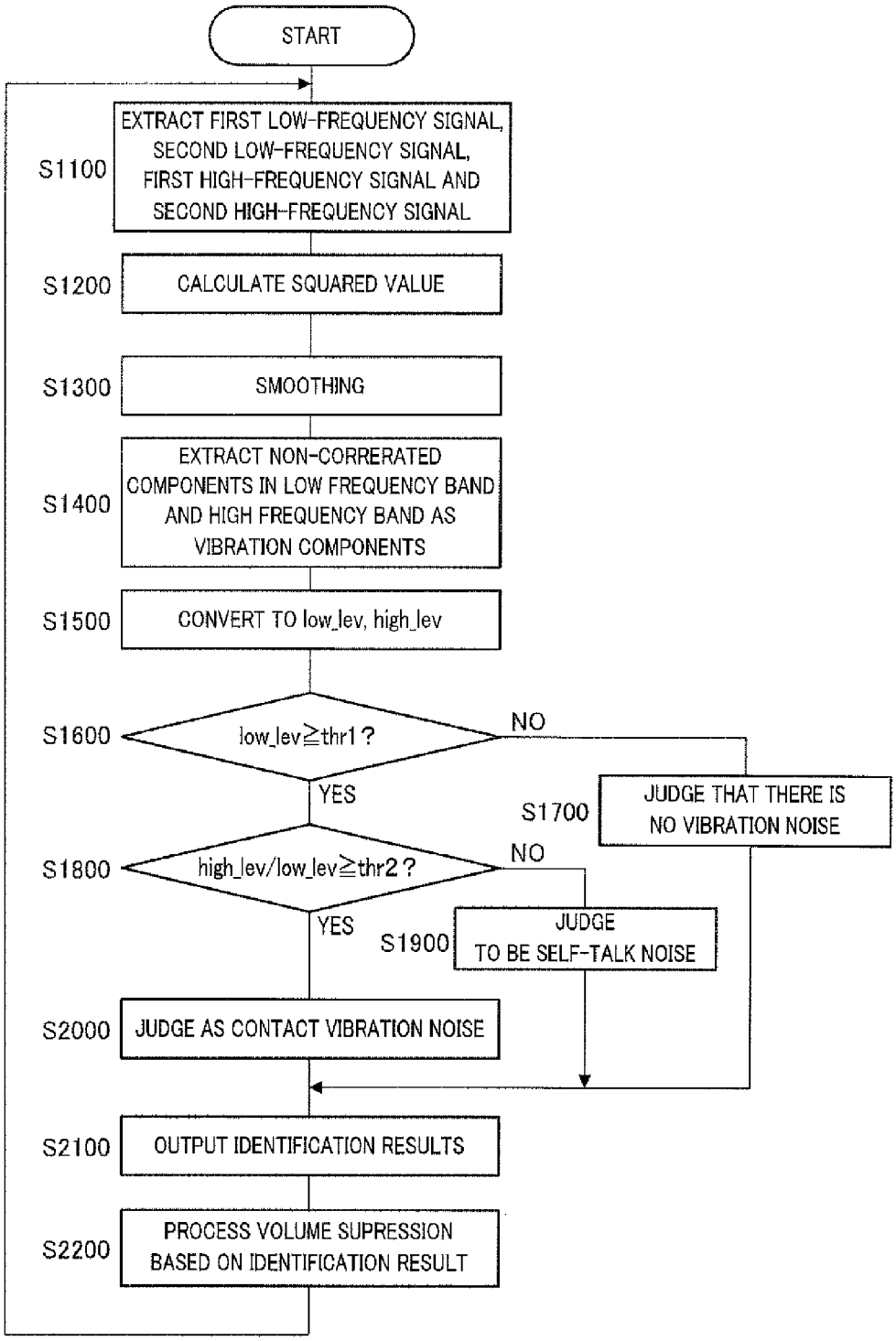
FIG. 7 is a flowchart showing an example of the operation of the hearing aid according to Embodiment 2 of the present invention.

FIG. 7 is a flowchart showing an example of the operation of hearing aid 100. Hearing aid 100 starts the operation shown in FIG. 7, for example, when a power switch or a function related to feedback noise suppression is set to on, and ends operation, for example, when the power switch or the function related to feedback noise suppression is set to off. It is assumed that, during the operation shown in FIG. 7, hearing aid 100 continues to obtain the first collected sound signal and the second collected sound signal, and to perform hearing aid processing to generate an acoustic signal and output a hearing aid sound.

First, at step S1100 first frequency band signal extracting section 121-1 extracts the first low-band signal and the first high-band signal from the first collected sound signal. Second frequency band signal extracting section 121-2 extracts the second low-band signal and the second high-band signal from the second collected sound signal.

Then, at step S1200, low-frequency vibration component extracting section 122-1 calculates the squared value of the first low-band signal and the squared value of the second low-band signal as the first low-band level signal and second low-band level signal before smoothing. High-frequency vibration component extracting section 122-2 calculates the squared value of the first high-band signal and the squared value of the second high-band signal as the first high-band level signal and second high-band level signal before smoothing.

Then, at step S1300, low-frequency vibration component extracting section 122-1 smoothes each of the first low-band level signal and second low-band level signal before smoothing and calculates the smoothed first low-band level signal and second low-band level signal. High-frequency vibration component extracting section 122-2 smoothes each of the first high-band level signal and second high-band level signal before smoothing and calculates the smoothed first high-band level signal and second high-band level signal.

Then, at step S1400, low-frequency vibration component extracting section 122-1 extracts the non-correlated components in the low-frequency band from the smoothed first low-band level signal and second low-band level signal as the low-frequency band vibration components. High-frequency vibration component extracting section 122-2 extracts the non-correlated components in the high-frequency band from the smoothed first high-band level signal and second high-band level signal as the high-frequency band vibration components.

Then, at step S1500, low-frequency vibration component extracting section 122-1 calculates a signal that is the absolute value of the non-correlated components in the low-frequency band as the low-frequency vibration component level signal. High-frequency vibration component extracting section 122-2 also calculates a signal that is the absolute value of the non-correlated components in the high-frequency band as the high-frequency vibration component level signal. That is, low-frequency vibration component extracting section 122-1 and high-frequency vibration component extracting section 122-2 convert the low-band non-correlated components and high-band non-correlated components to the low-frequency vibration component level low_lev and high-frequency vibration component level high_lev, respectively.

Then, at step S1600, vibration noise identifying section 130 judges whether or not the low-frequency vibration component level low_lev indicating the low-frequency vibration component level is equal to or greater than a pre-established first threshold thr1.

In the case where the situation that the low-frequency vibration component level low_lev is equal to or greater than the first threshold thr1 continues for a prescribed amount of time or more, vibration noise identifying section 130 may judge that the low-frequency vibration component level low_lev is equal to or greater than the first threshold thr1.

If vibration noise identifying section 130 judges that the low-frequency vibration component level low_lev is less than the first threshold thr1 (NO at S1600), processing proceeds to step S1700. If vibration noise identifying section 130 judges that the low-frequency vibration component level low_lev is equal to or greater than the first threshold thr1 (YES at S1600), processing proceeds to step S1800.

At step S1700, vibration noise identifying section 130 judges that there is no vibration noise, and processing proceeds to step S2100.

At step S1800, vibration noise identifying section 130 determines the ratio of the high-frequency vibration component level high_lev with respect to the low-frequency vibration component level low_lev (high_lev/low_lev; hereinafter "band level ratio"). Vibration noise identifying section 130 judges whether or not the determined band level ratio is equal to or greater than a pre-established second threshold thr2.

If the vibration noise identifying section 130 judges that the band level ratio (high_lev/low_lev) is less than the second threshold thr2 (NO at S1800), processing proceeds to step S1900. If the vibration noise identifying section 130 judges that the band level ratio (high_lev/low_lev) is equal to or greater than the second threshold thr2 (YES at S1800), processing proceeds to step S2000.

At step S1900, vibration noise identifying section 130 judges that there is vibration noise and that the vibration noise is self-talk noise, and processing proceeds to step S2100.

At step S2000, vibration noise identifying section 130 judges that there is vibration noise and that the vibration noise is contact vibration noise, and processing proceeds to step S2100.

At step S2100, vibration noise identifying section 130 outputs the identification result which indicates one of "no vibration noise," "self-talk noise exists," and "contact vibration noise exists," to suppression processing section 142 via output section 160. By doing this, vibration noise identifying section 130 instructs suppression processing section 142 to execute prescribed processing for feedback noise suppression. The identification result can be expressed as a value, such as vib_noi_type=0 for no vibration noise, 1 for self-talk noise exists, and 2 for contact vibration noise exists.

Then, at step S2200, suppression processing section 142, based on the identification result, executes prescribed processing for feedback noise suppression, and processing returns to step S1100. In this case, the prescribed processing for feedback noise suppression is, for example, processing to reduce the volume of the acoustic signal during the time when the identification result is "contact vibration noise exists."

If the identification result is "contact vibration noise exists," it is desirable that suppression processing section 142 makes the volume suppression larger and that the volume is controlled so that the suppression and release operations in the suppression control are performed gradually. By doing this, hearing aid 100 can suppress feedback noise sufficiently, in the event that feedback noise occurs due to a large change in the acoustic system when hearing aid 100 is put on or removed.

By this type of operation, hearing aid 100 can detect contact vibration noise from the collected sound signals and execute the prescribed processing for feedback noise suppression.

The above completes the description of the operation of hearing aid 100.

The following is a description, using an example of the difference in the signal condition between self-talk noise and contact vibration noise, that hearing aid 100 of the present embodiment can detect contact vibration noise from the collected sound signals.

FIG. 8 shows examples of the conditions of various signals that includes self-talk noise. This case shows the experimental data for the case in which the passband cutoff frequency band of the lowpass filter of the first and second frequency band signal extracting sections 121-1 and 121-2 is 50 to 180 Hz, and the passband cutoff frequency band of the highpass filter is 2000 to 3000 Hz.

Figure 8A:
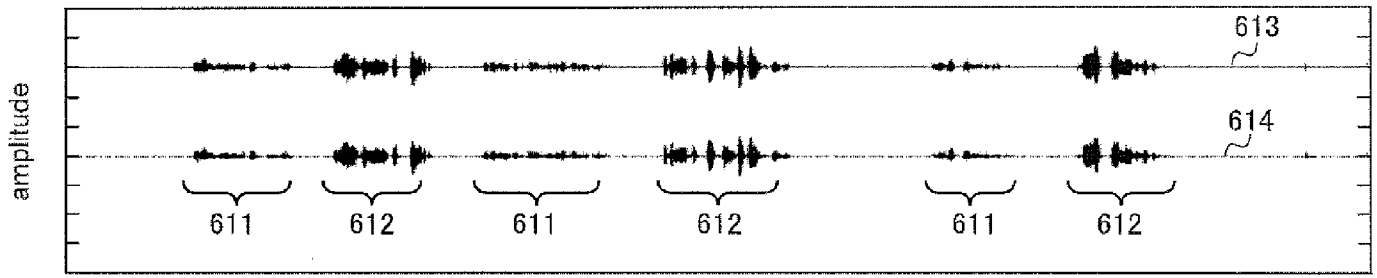
FIG. 8 is a drawing showing an example of the states of signals for the case in which self-talk noise is included in Embodiment 2 of the present invention.
Figure 8B:
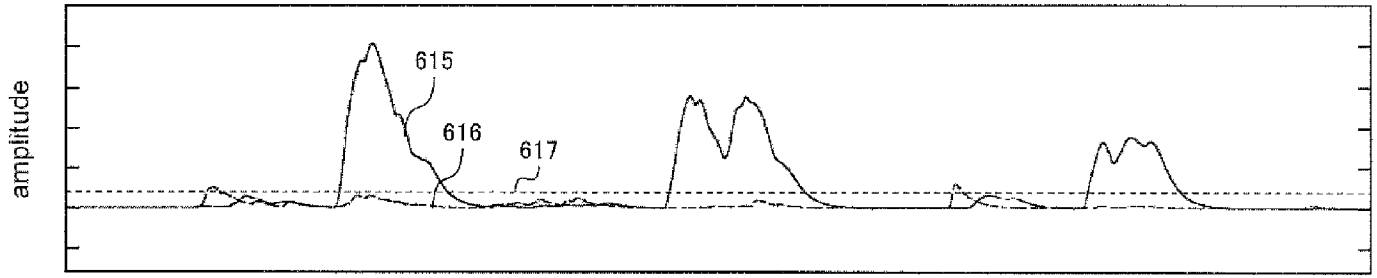
Figure 8C:
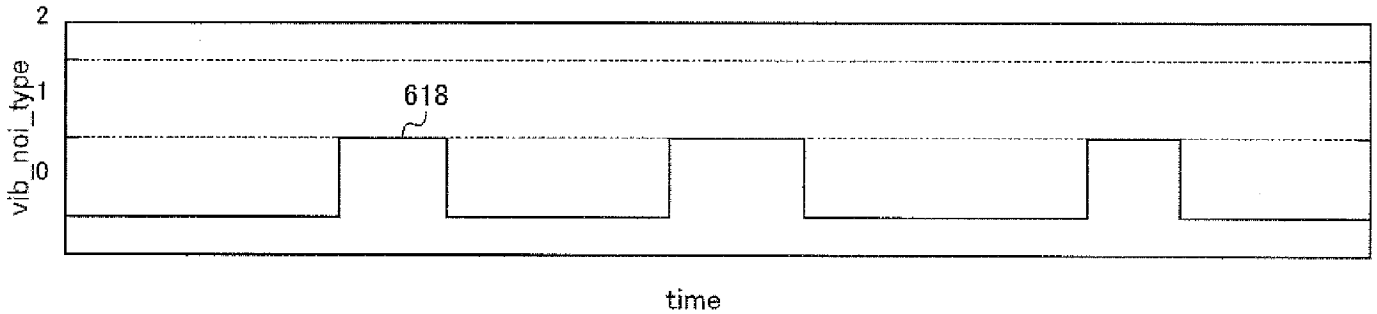

FIG. 8A shows the waveforms of the first collected sound signal and the second collected sound signal. FIG. 8B shows the waveforms of the low-frequency vibration component level signal and the high-frequency vibration component level signal, and the first threshold. FIG. 8C shows the change in the identification result.

As shown in FIG. 8A, vibration component extracting section 120 inputs first collected sound signal 613 and second collected sound signal 614 that include the speech of the another person (hereinafter "other talk") 611 and self-talk 612.

As shown in FIG. 8B, in the sections of other talk 611, low-frequency vibration component level 615 is, on average, small. Additionally, in this case, low-frequency vibration component level 615 (low_lev) does not exceed the first threshold 617 (thr1).

In one part of the sections of other talk 611, high-frequency vibration component level 616 becomes large. This is because, with regard to high-frequency vibration component level 616 (high_lev), the influence of the hearing aid surrounding environment and the influence of the phase difference destroy the correlation between the microphone outputs.

In contrast, as shown in FIG. 8B, in the sections of self-talk 612, low-frequency vibration component level 615 (low_lev) becomes large and exceeds first threshold 617 (thr1). This is because self-talk 612 includes solid-propagated sound by bone conduction of voiced sounds.

Also, in the sections of self-talk 612, high-frequency vibration component level 616 (high_lev) is low. This is because the bone conduction of the high-frequency components of the spoken voice is small compared to low-frequency components, and because there are few components in the voice, it is difficult for them to be transmitted to the microphones of hearing aid as vibration.

From the above, in the sections of self-talk 612, the band level ratio high_lev/low_lev is low and does not exceed the second threshold (thr2).

That is, in the high-frequency vibration components, compared to the low-frequency vibration components, the ratio of the other talk components to the self-talk components is relatively large. Therefore, as shown in FIG. 8C, identification result 618 (vib_noi_type) is "self-talk noise" (vib_noi_type=1) in the sections of self-talk 612. Identification result 618 (vib_noi_type) is "no vibration noise" (vib_noi_type=0) in other sections.

FIG. 9 shows examples of the conditions of various signals that include contact vibration noise, corresponding to FIG. 8.

Figure 9A:
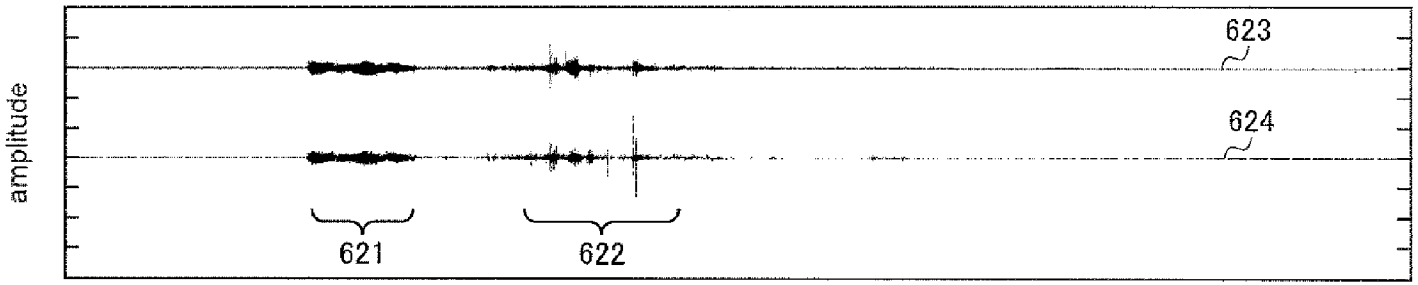
FIG. 9 is a drawing showing an example of the states of signals for the case in which contact vibration noise is included in Embodiment 2 of the present invention.

As shown in FIG. 9A, vibration component extracting section 120 inputs first collected sound signal 623 and second collected sound signal 624 that include self-talk 621 and contact vibration noise 622 (the sliding sound when hearing aid 100 is removed).

Figure 9B:
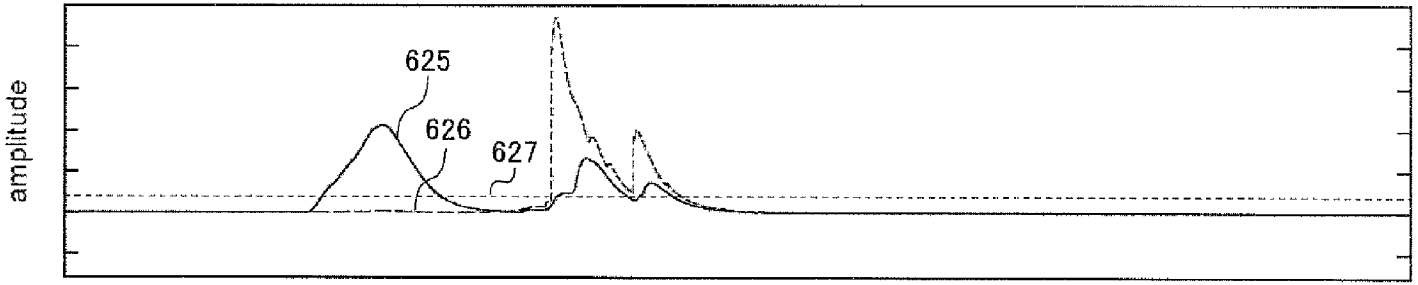

As shown in FIG. 9B, in the section of contact vibration noise 622, both low-frequency vibration component level 625 (low_lev) and high-frequency vibration component level 626 (high_lev) are high. Therefore, low-frequency vibration component level 625 (low_lev) exceeds first threshold 627 (thr1). Also, the band level ratio high_lev/low_lev is high, and exceeds the second threshold (thr2).

Figure 9C:
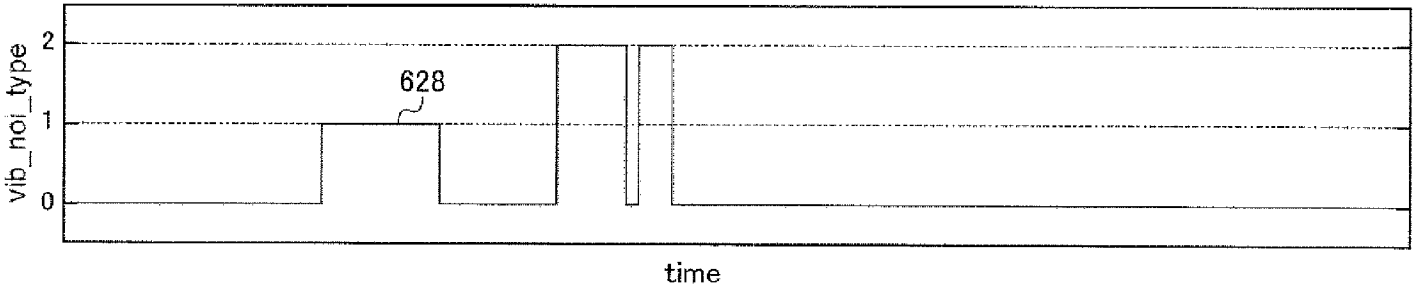

Therefore, as shown in FIG. 9C, identification result 628 (vib_noi_type) in the section of vibration component noise 622 is "contact vibration noise exists" (vib_noi_type=2). Identification result 628 (vib_noi_type) in the section of self-talk noise 621 is "self-talk noise exists" (vib_noi_type=1). In other sections, identification result 628 (vib_noi_type) is "no vibration noise" (vib_noi_type=0).

In this manner, hearing aid 100 according to the present embodiment can detect contact vibration noise from the collected sound signals with good accuracy.

In this manner, hearing aid 100 according to the present embodiment extracts non-correlated components between the collected sound signals as frequency band specific vibration components and, based on the levels in the high-frequency band thereof, distinguishes noise, thereby enabling detection of contact vibration noise from the collected sound signals.

Also, by doing this, by using the two microphones 110 for collecting sounds already provided in hearing aid 100, and without providing a new sensor in addition to the microphones, hearing aid 100 according to the present embodiment can suppress feedback noise from the beginning of the occurrence thereof.

Additionally, by doing this, hearing aid 100 according to the present embodiment can suppress feedback noise while achieving a compact, lightweight, and energy-efficient hearing aid.

Also, hearing aid 100 according to the present embodiment, as described above, by analyzing the frequency band specific vibration components, can distinguish self-talk noise and contact vibration noise. By doing this, because hearing aid 100 can detect self-talk noise and suppress feedback noise with respect to the self-talk acoustic signal from the time that the feedback noise is detected with relative light suppression, it is possible to avoid the adverse effects of applying excessive suppression and the like.

It is desirable that the processing for sound pressure sensitivity correction between the microphones for each band is performed during collection of air-propagated sound (that is, when there is little solid-propagated sound). Therefore, hearing aid 100 may be made to stop the updating of the correction multiplier when the levels of the low-band and high-band non-correlated components are equal to or greater than a certain level. By doing this, hearing aid 100 performs sensitivity correction only during the input of air-propagated sound having high correlation, thereby enabling extraction of non-correlation components with better accuracy.

Hearing aid 100, rather than the squared values of the low-band signal and high-band signal, may calculate the values that are the square root of the squared values as the low-band level signal and high-band level signal.

Embodiment 3

Embodiment 3 of the present invention is an example of a hearing aid that extracts (frequency band specific) vibration noise from a plurality of bands divided more finely than in Embodiment 2, and that, based on the spectral pattern of the vibration noise components, detects contact vibration noise. In the present embodiment, the hearing aid extracts vibration noise components for each divided frequency band having N different pre-established center frequencies (where N is an integer of 3 or larger).

First, the configuration of the hearing aid according to the present embodiment will be described.

Figure 10:
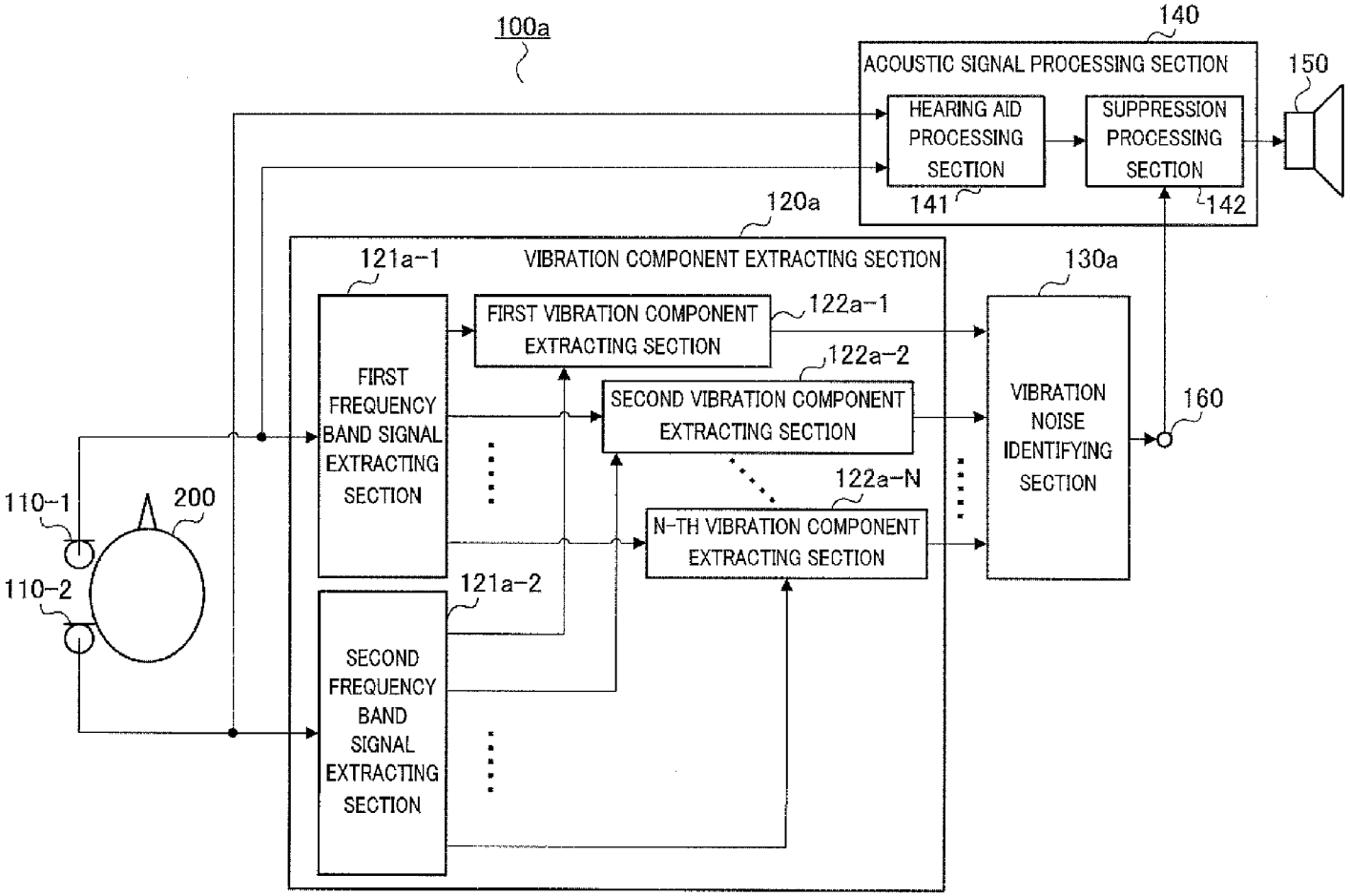
FIG. 10 is a block diagram showing an example of the configuration of a hearing aid according to Embodiment 3 of the present invention.

FIG. 10 is a block diagram showing an example of the configuration of a hearing aid according to the present embodiment and corresponds to FIG. 2 of Embodiment 2. The same reference signs are assigned to parts that are the same as in FIG. 2, and the descriptions thereof are omitted.

In FIG. 10, hearing aid 100*a* has vibration component extracting section 120*a* instead of vibration component extracting section 120 as shown in FIG. 2.

Vibration component extracting section 120*a* has, instead of the configuration as shown in FIG. 2, first frequency band signal extracting section 121*a*-1, second frequency band signal extracting section 121*a*-2 and first to Nth vibration component extracting sections 122*a*-1 to 122*a*-N, which correspond to the above-described divided frequency bands.

Also, hearing aid 100*a* has vibration noise identifying section 130*a* instead of vibration noise identifying section 130 as shown in FIG. 2.

First frequency band signal extracting section 121*a*-1 extracts signals for the above-described N divided frequency bands from the first collected sound signal. Furthermore, first frequency band signal extracting section 121*a*-1 outputs the extracted signals to first to Nth vibration component extracting sections 122*a*-1 to 122*a*-N corresponding to the respective divided frequency bands.

Second frequency band signal extracting section 121*a*-2 extracts signals for the above-described N divided frequency bands from the second collected sound signal. Furthermore, second frequency band signal extracting section 121*a*-2 outputs the extracted signals to first to Nth vibration component extracting sections 122*a*-1 to 122*a*-N corresponding to the respective divided frequency bands.

First frequency band signal extracting section 121*a*-1 and second frequency band signal extracting section 121*a*-2 have, for example, the same configuration and can use an N-divided filter bank or an FTT.

Figure 11:
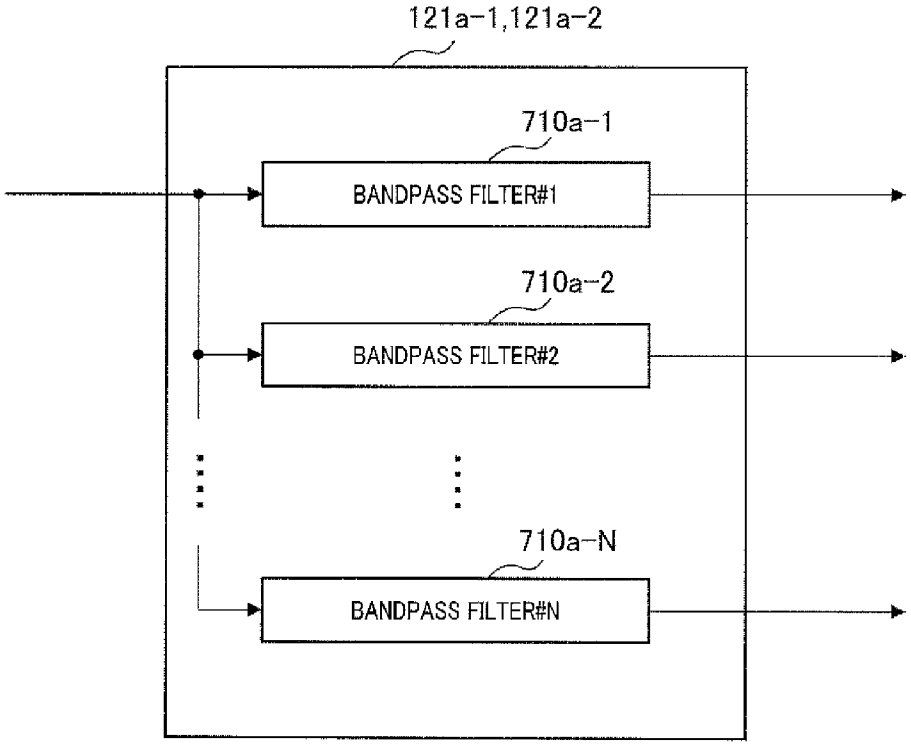
FIG. 11 is a block diagram showing an example of the configuration of first and second frequency band signal extracting sections using a filter bank in Embodiment 3 of the present invention.

FIG. 11 is a block diagram showing an example of the configuration of first and second frequency-band signal extracting sections 121*a*-1 and 121*a*-2 using the N-divided filter bank, this corresponding to FIG. 5 of Embodiment 2.

As shown in FIG. 11, first and second frequency band signal extracting sections 121*a*-1 and 121*a*-2, for example, have first to N-th bandpass filters 710*a*-1 to 710*a*-N corresponding to the above-described divided frequency bands. First to N-th bandpass filters 710*a*-1 to 710*a*-N perform filtering the collected sound signals with passbands that are the corresponding divided bands.

Figure 12:
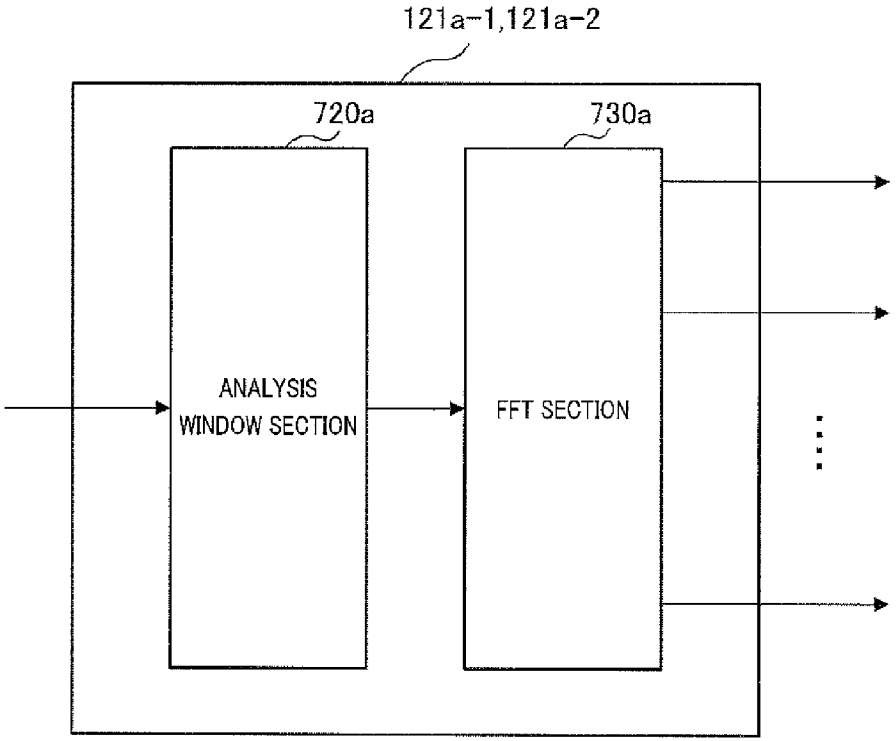
FIG. 12 is a block diagram showing an example of the configuration of first and second frequency band signal extracting sections using FFT in Embodiment 3 of the present invention.

FIG. 12 is a block diagram showing an example of the configuration of first and second frequency band signal extracting sections 121*a*-1 and 121*a*-2 that use an FFT.

As shown in FIG. 12, first and second frequency band signal extracting sections 121*a*-1 and 121*a*-2 have, for example, analysis window section 720*a* and FFT section 730*a*.

Analysis window section 720*a* applies an analysis window to the first collected sound signal. From the standpoint of frequency resolution and preventing spectral leakage, a window function suitable to, for example, the purpose of extraction and identification in later stages (for example, a Hanning window) is selected as the analysis window.

FFT section 730*a* divides the output signal of analysis window section 720*a* into frequency spectra of the above-noted divided frequency bands. That is, FFT section 730*a* converts the signal to which the analysis window has been applied, from a time waveform to a frequency signal, and generates complex frequency spectra.

The spectral resolution of FFT section 730*a* may be number of divided bands (N) or may be a higher number. In the latter case, FFT section 730*a* may calculate spectra (spectral bins) with high-resolution and output information that is grouped in a plurality of spectral bins into divided bands. The configuration of the spectral bin grouping is desirably a configuration in which the difference between vibration components to be distinguished tends to appear prominently along the frequency axis. That is, it is desirable that FFT section 730*a* perform grouping of frequency bands in which vibration components tend to appear.

In the following, the signal in each divided frequency band output by first frequency band signal extracting section 121*a*-1 will be referred to as a "first frequency band specific signal" and the signal in each divided frequency band output by second frequency band signal extracting section 121*a*-2 will be referred to as "second frequency band specific signal."

First to N-th vibration component extracting sections 122*a*-1 to 122*a*-N in FIG. 10 each extract, from the first frequency band specific signal and the second frequency band specific signal input thereto, the corresponding divided frequency band vibration components. Additionally, first to N-th vibration component extraction sections 121*a*-1 to 121*a*-N output signals indicating the levels of the extracted vibration components to vibration noise identifying section 130*a*. First to N-th vibration component extracting sections 122*a*-1 to 122*a*-N, for example, have the same configuration as low-frequency vibration component extracting section 122-1 and high-frequency vibration component extracting section 122-2 shown in FIG. 6 of Embodiment 2.

If first and second frequency band signal extracting sections 121*a*-1 and 121*a*-2 use an FFT, each vibration component extracting section 122*a* performs the above-described square value calculation to calculate the power spectrum using the complex spectra. If a plurality of grouped spectral bin values are input as the frequency band specific signals to each vibration component extracting section 122*a*, the average, for example, can be taken of these values (power spectrum).

In the following, the signals for each divided frequency band output by first to N-th vibration component extracting sections 122*a*-1 to 122*a*-N are referred to as "frequency band specific vibration component level signals."

Vibration noise identifying section 130*a* stores preliminarily the spectral pattern of the self-talk noise vibration components (hereinafter "self-talk template") and the spectral pattern of the contact vibration noise vibration components each in a normalized form. The spectral pattern of the contact vibration noise vibration components will be referred to as the "contact vibration template." In the present embodiment, the normalization of the spectral patterns means setting the maximum value of each of the divided frequency bands to 1, for example, by dividing the values of all the divided frequency bands by the maximum value of each of the respective frequency bands. Vibration noise identifying section 130*a* obtains a spectral pattern (hereinafter "detected noise pattern") of the vibration components of the collected sound signals indicated by first to N-th frequency band specific vibration component level signals. Vibration noise identifying section 130*a* judges that contact vibration noise has occurred under the condition in which a detected noise pattern is more similar to the contact vibration template than to the self-talk template.

The above completes the description of the hearing aid according to the present embodiment.

Next, the operation of hearing aid 100*a* of the present embodiment will be described.

Figure 13:
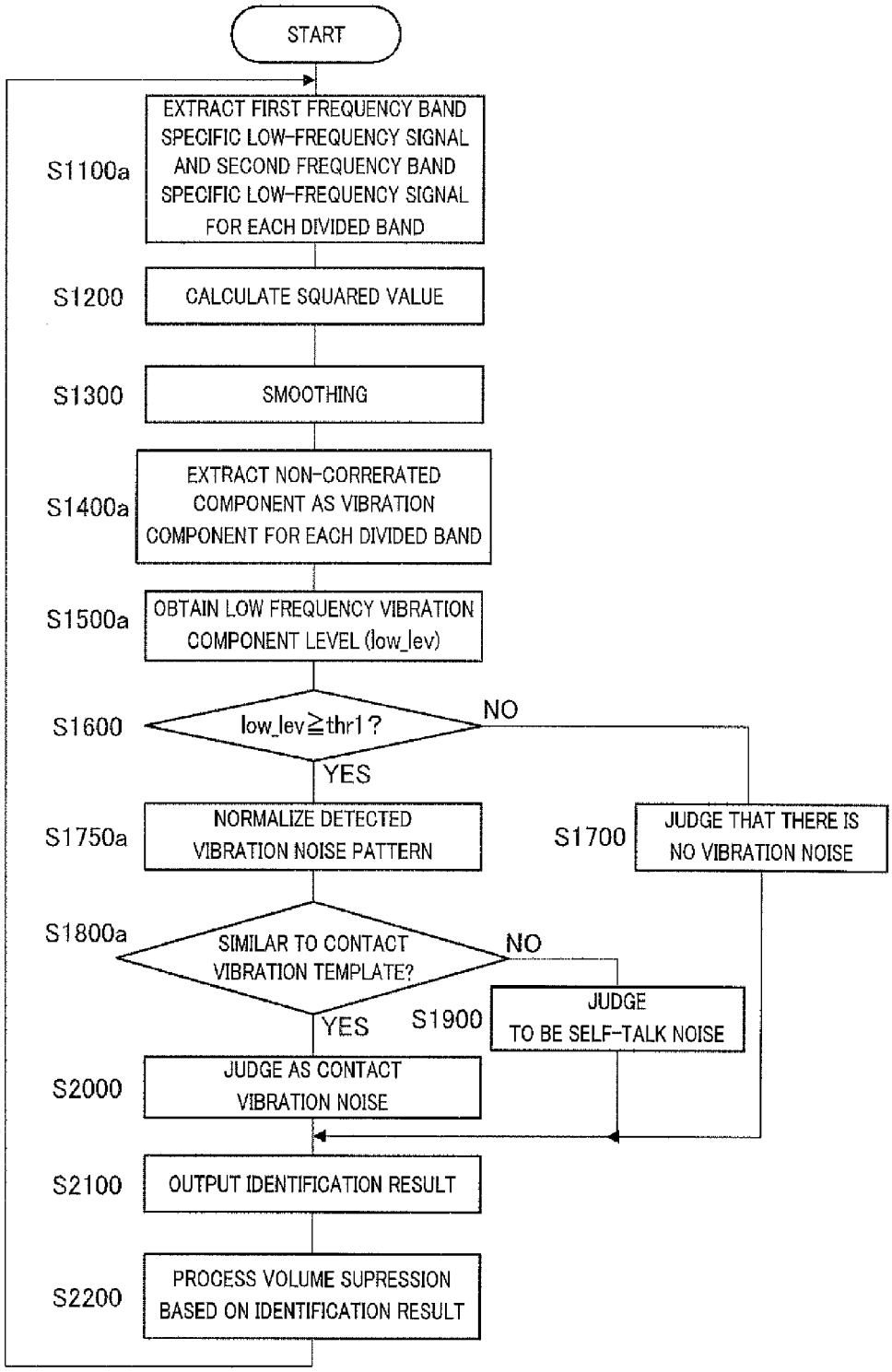
FIG. 13 is a flowchart showing an example of the operation of the hearing aid according to Embodiment 3 of the present invention.

FIG. 13 is a flowchart showing an example of the operation of hearing aid 100*a*, this corresponding to FIG. 7 in Embodiment 2. The same reference signs are assigned to parts that are the same as in FIG. 7, and the descriptions thereof are omitted.

First, at step S1100*a*, first frequency band signal extracting section 121*a*-1 extracts, from the first collected sound signal, for each divided frequency band, the first frequency band specific signals. Second frequency band signal extracting section 121*a*-2 extracts, from the second collected sound signal, for each divided frequency band, the second frequency band specific signals.

Then, at step S1400*a*, first to N-th vibration component extracting sections 122*a*-1 to 122*a*-N extract, for each divided frequency band, as vibration components, non-correlated components between the first frequency band specific signal and the second frequency band specific signal.

Then, at step S1500*a*, vibration noise identifying section 130*a* obtains the low-frequency vibration component level low_lev described with regard to Embodiment 2. For example, vibration noise identifying section 130*a* calculates, as the low-frequency vibration component level low_lev, the average value of all of the frequency band specific vibration component level signals included in the low-band described with regard to Embodiment 2.

Then, at step S1600, vibration noise identifying section 130*a* judges whether or not the low-frequency vibration component level low_lev is equal to or greater than the first threshold thr1.

If vibration noise identifying section 130*a* judges that the low-frequency vibration component level low_lev is equal to or greater than the first threshold thr1 (YES at S1600), processing proceeds to step S1750*a*.

At step S1750*a*, vibration noise identifying section 130*a* normalizes the detected noise pattern indicated by the first to N-th frequency band specific vibration component level signals.

Then, at step S1800*a*, vibration noise identifying section 130*a* judges whether or not the normalized detected noise pattern (hereinafter, simply "detected noise pattern") is more similar to the contact vibration template than to the self-talk template.

Specifically, vibration noise identifying section 130*a* quantifies the degree of similarity between the detected noise pattern and the self-talk template and the degree of similarity between the detected noise pattern and the contact vibration template, and compares the degrees of similarity.

For example, vibration noise identifying section 130*a* uses the mean square error as the degree of similarity. In this case, vibration noise identifying section 130*a* uses, for example, the following Equation 1 to calculate the mean square error μm (μ0, μ1) with respect to the m-th template (for example, m=0 being the self-talk template, and m=1 being the contact vibration template). In the k-th divided frequency band, the detected noise pattern value is taken as xk, and the m-th template value is taken as ym, k.

(Equation 1)

$$\mu_m = \sqrt{\frac{\sum_{k=1}^{N}(x_k - y_{m,k})^2}{N}} \quad [1]$$

Vibration noise identifying section 130*a* compares the calculated mean square error μ0 with respect to the self-talk template, and the calculated mean square error μ1 with respect to the contact vibration template, and judges that the detected noise pattern is more similar to the template having the smaller value. That is, if μ1>μ0, vibration noise identifying section 130*a* judges that the detected noise pattern is more similar to the self-talk template than to the contact vibration template.

If vibration noise identifying section 130*a* judges that the detected noise pattern is less similar to the contact vibration template than to the self-talk template (NO at S1800*a*), processing proceeds to step S1900. If the vibration noise identifying section 130*a* judges that the detected noise pattern is more similar to the contact vibration template than to the self-talk template, (YES at S1800*a*), processing proceeds to step S2000.

By such operation, hearing aid 100*a* extracts vibration noise components from each of a plurality of frequency bands, and can detect contact vibration noise based on the spectral patterns of the vibration noise components.

The above completes the description of the operation of hearing aid 100*a*.

In this manner, hearing aid 100*a* according to the present embodiment, compared with Embodiment 2, uses frequency band specific vibration noise components extracted more finely, to detect contact vibration noise. By doing this, hearing aid 100*a* is preferable in cases in which, for example, there is a large amount of variation in the band level ratio in accordance with the surrounding environment or the usage condition. That is, hearing aid 100*a* is capable of more accurate vibration extraction and identification.

Because hearing aid 100*a* according to the present embodiment has additional functional parts compared with the case of Embodiment 2 in which processing is performed with regard to a frequency band divided into two, there could be cases in which there are increased constraints regarding hardware that performs signal processing. Therefore, hearing aid 100*a* according to the present embodiment is preferable for cases in which the situation is one in which the constraints regarding signal processing hardware are less than in Embodiment 2, and cases in which it is desired to identify vibration noise with particularly high accuracy.

Embodiment 4

Embodiment 4 of the present invention is an example that is applied to an audio limiter in the suppression processing section of Embodiment 2.

First, the configuration of a hearing aid according to the present embodiment will be described.

Figure 14:
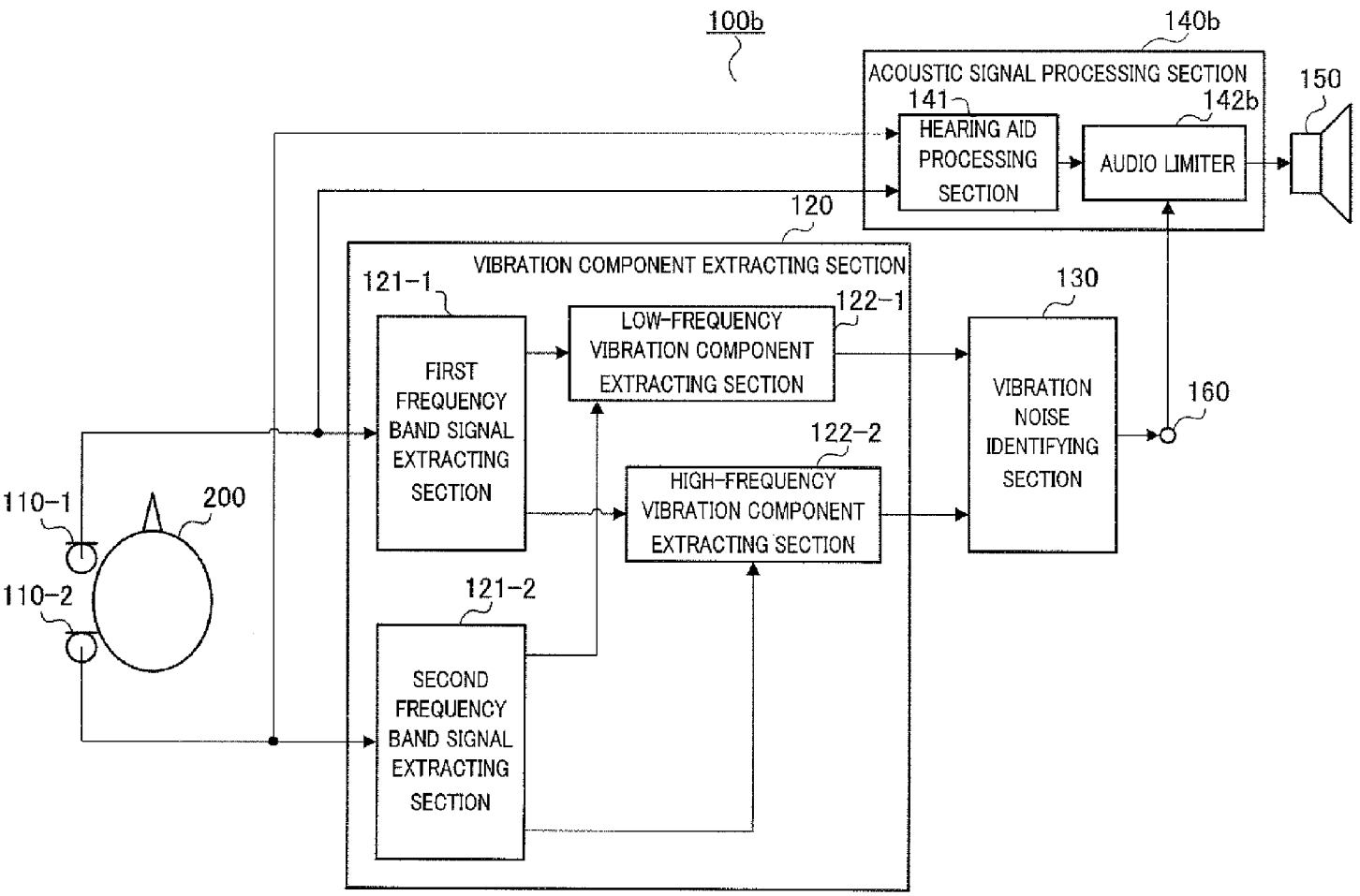
FIG. 14 is a block diagram showing an example of the configuration of a hearing aid according to Embodiment 4 of the present invention.

FIG. 14 is a block diagram showing an example of the configuration of a hearing aid according to the present embodiment, and corresponds to FIG. 2 of Embodiment 2. The same reference signs are assigned to parts that are the same as in FIG. 2, and the descriptions thereof are omitted.

In FIG. 14, hearing aid 100*b* has acoustic signal processing section 140*b* instead of acoustic signal processing section 140 as shown in FIG. 2. Acoustic signal processing section 140*b* has audio limiter 142*b* as a specific example of suppression processing section 142 as shown in FIG. 2.

As an above-described prescribed processing for feedback noise suppression, audio limiter 142*b* processes volume suppression of the acoustic signal so that it does not exceed a set output level during the time when the identification result is "contact vibration noise exists." That is, audio limiter 142*b* adaptively reduces (limits) the volume so that there is no volume at or exceeding a certain level.

Specifically, in this case, audio limiter 142*b* changes a limiter parameter each time the vibration noise state changes.

The limiter parameter includes a limiter point and a release time. The limiter point is a target value for suppression of the output level, and the lower the limiter point is, the smaller is the volume of acoustic signal. The release time is a time length up until release of the output level suppression, and the longer the release time is, the longer is the state continued in which the volume of the acoustic signal is suppressed.

In the present embodiment, audio limiter 142*b* holds the set of limiter point P1 and release time t1 in accordance with the identification result of "contact vibration noise exists."

Also, audio limiter 142*b* holds the set of limiter point P2 and release time t2 in accordance with the identification result of "self-talk noise exists."

Furthermore, audio limiter 142*b* holds the set of limiter point P3 and release time t3 in accordance with the identification result of "no vibration noise."

These parameters satisfy the relationships shown in the following Equations 2 and 3.

[2]

$$t3<t2<t1 \quad \text{(Equation 2)}$$

[3]

$$P1<P2<P3 \quad \text{(Equation 3)}$$

Release time t3 represents a default value and the lower limit value of the release time. Limiter point P3 represents a default value and the upper limit value of the limiter point.

Figure 15:
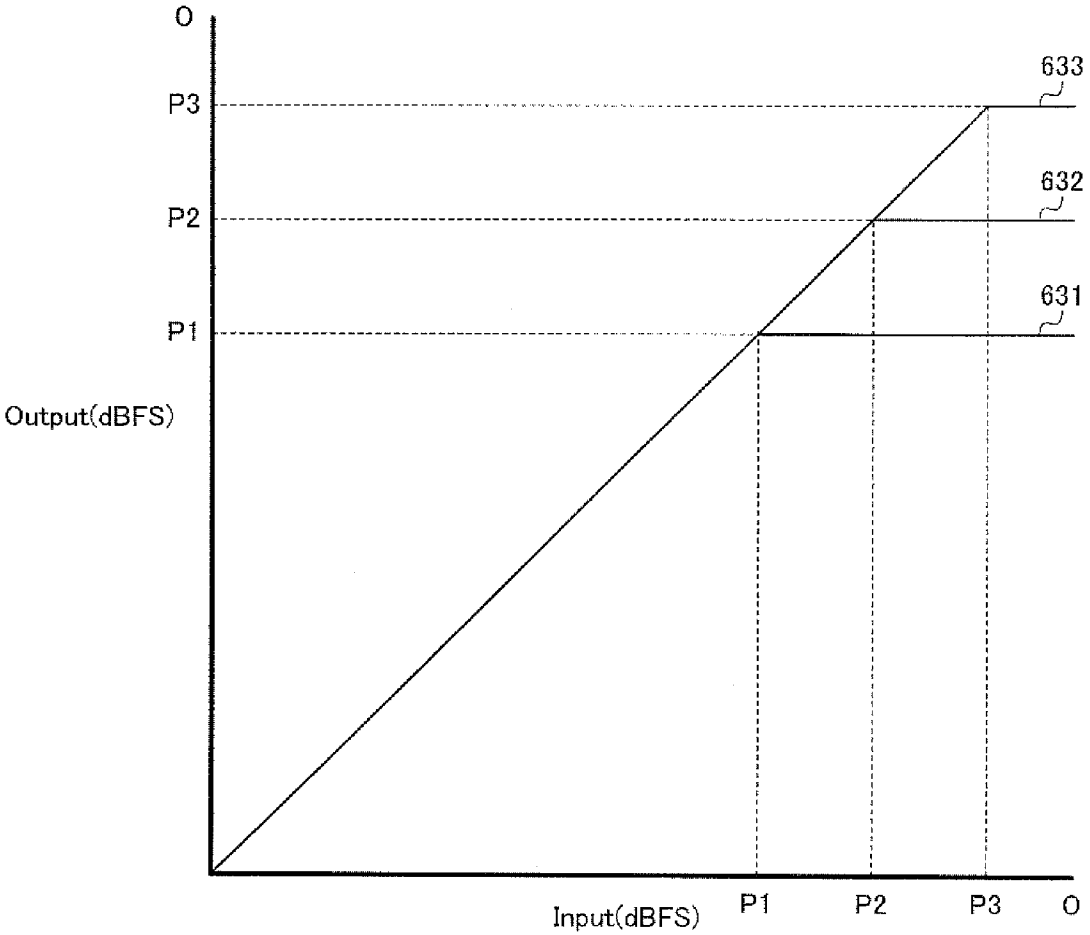
FIG. 15 is a drawing showing an example of the input/output characteristics of an audio limiter in Embodiment 4 of the present invention.

FIG. 15 shows an example of the input/output characteristics of audio limiter 142*b*. In FIG. 15, the horizontal axis represents the level (volume level) of the input signal to audio limiter 142*b*, and the vertical axis represents the output signal level (volume level) from audio limiter 142*b*.

In FIG. 15, first to third input/output characteristics 631 to 633 correspond, in that sequence, to limiter points P1 to P3. Limiter points P1 to P3 are related by Equation 3.

That is, when limiter point P1 is set, although a signal having a volume level of limiter point P1 or lower is output as is, a signal having a volume level exceeding limiter point P1 will be limited to the volume level of limiter point P1.

Audio limiter 142*b* switches the corresponding limiter parameter in response to the input identification result.

That is, in the case of "no vibration noise," for example, audio limiter 142*b* either does not particularly make the volume of the acoustic signal small or, if it does make it small, releases it quickly.

In the case of "self-talk noise exists," audio limiter 142*b* reduces the limiter point a little to make the acoustic signal volume small, and releases this in a relatively short time.

In the case of "contact vibration noise exists," audio limiter 142*b* reduces the limiter point as much as possible to make the acoustic signal volume small, and releases this slowly.

For example, as described above, feedback noise tends to occur when hearing aid 100*b* is put on or removed. Therefore, hearing aid 100*b*, by limiter parameter switching as described above, can minimize acoustic oscillation (feedback noise) between audio receiver 150 and microphones 110.

Also, hearing aid 100*b*, for example, when listening to other talk, self-talk can become difficult to hear. Hearing aid 100*b*, therefore, by limiter parameter switching as described above, can collect sound and emit sound while suppressing lost first utterances of another person's speech, and suppressing self-talk.

The above completes the description of the configuration of hearing aid 100*b*.

Next, the operation of hearing aid 100*b* will be described.

The operation of hearing aid 100*b* differs from the flowchart shown in FIG. 7 regarding Embodiment 2 only with regard to step S2200. Given this, the processing executed by hearing aid 100*b* at step S2200 of FIG. 7 (that is, volume limiting) will be described.

Figure 16:
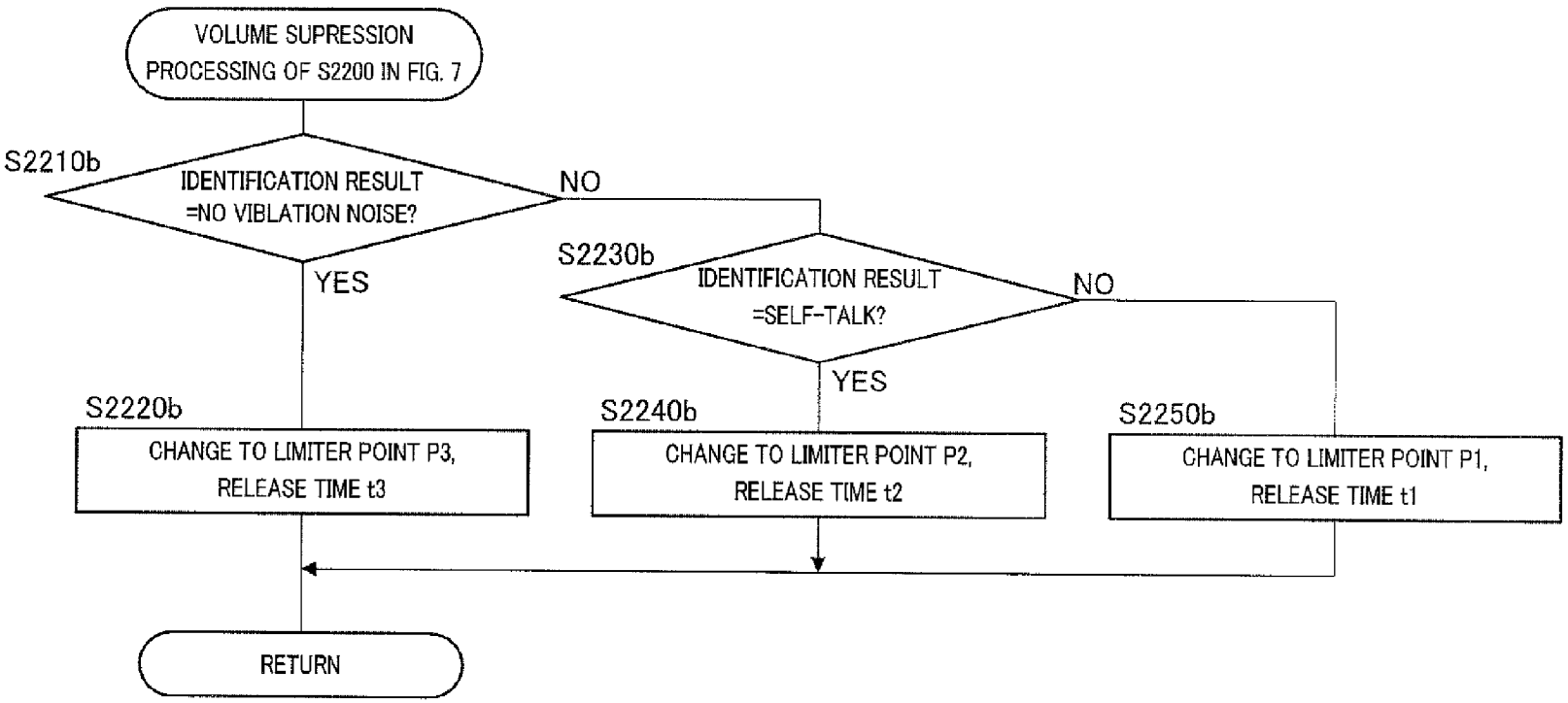
FIG. 16 is a flowchart showing an example of volume suppression control executed by the hearing aid according to Embodiment 4 of the present invention.

FIG. 16 is a flowchart showing an example of the volume limiting processing executed by hearing aid 100*b*.

First, at step S2210*b*, audio limiter 142*b* judges whether or not the identification result is "no vibration noise."

If audio limiter 142*b* judges that the identification result is "no vibration noise" (YES at S2210*b*), processing proceeds to step S2220*b*. If audio limiter 142*b* judges that the identification result is not "no vibration noise" (NO at S2210*b*), processing proceeds to step S2230*b*.

At step S2220*b*, audio limiter 142*b* changes the limiter parameters to limiter parameters corresponding to "no vibration noise" (limiter point P3, release time t3) and return is made to the processing of FIG. 7.

If audio limiter 142*b* has already set the limiter parameters corresponding to "no vibration noise," those settings are maintained. It is desirable that, when changing the values of the limiter parameters to those limiter parameters corresponding to "no vibration noise," audio limiter 142*b* use an integrator or the like to gradually change the limiter point and release time. By doing this, hearing aid 100*b* of the present embodiment can naturally emit surrounding sounds to the ear hole.

At step S2230*b*, audio limiter 142*b* judges whether or not the identification result is "self-talk noise exists."

If audio limiter 142*b* judges that the identification result is "self-talk noise exists" (YES at S2230*b*), processing proceeds to step S2240*b*. If audio limiter 142*b* judges that the identification result is not "self-talk noise exists," that is, that the identification result is "contact vibration noise exists" (NO at S2230*b*), processing proceeds to step S2250*b*.

At step S2240*b*, audio limiter 142*b* changes the limiter parameters to limiter parameters corresponding to "self-talk noise exists" (limiter point P2, release time t2), and return is made to the processing of FIG. 7. If audio limiter 142*b* has already set the limiter parameters corresponding to "self-talk noise exist," those settings are maintained.

At step S2250*b*, audio limiter 142*b* changes the limiter parameters to limiter parameters corresponding to "contact vibration noise exists" (limiter point P1, release time t1), and return is made to the processing of FIG. 7. If audio limiter 142*b* has already set the limiter parameters corresponding to "contact vibration noise exists," those settings are maintained.

The condition of hearing aid 100*b* mainly changes from the conditions when it is being put on and immediately thereafter, when it is in use, and when it being removed and immediately thereafter.

When hearing aid 100*b* is being put on and immediately thereafter, contact with the hand and ear causes the judgment "contact vibration noise exists." Thus, relatively strong limiting is applied.

When hearing aid 100*b* is in use and the user is silent the judgment of "no vibration noise" is made. Thus, relatively light limiting is applied.

When hearing aid 100*b* is in use and the user speaks the judgment of "self-talk noise exists" is made. Thus, moderate limiting is applied.

When hearing aid 100*b* is being removed and immediately thereafter contact with the hand and ear causes the judgment of "contact vibration noise exists" to be made. Thus, relatively strong limiting is again applied.

By operation such as described above, hearing aid 100*b* can suppress feedback noise with minimum sacrifice of flexibility of use.

In this manner, hearing aid 100*b* adopts audio limiter 142*b* that controls output level limitation with respect to the hearing aid processing output (acoustic signal) of hearing aid processing section 141.

By doing this, hearing aid 100*b* of the present embodiment can control volume in accordance with the identification result of the vibration noise. That is, hearing aid 100*b* according to the present embodiment is used as normally when vibration noise is not detected, and can suppress the volume when contact vibration noise is detected.

When self-talk noise is detected, hearing aid 100*b* of the present embodiment can limit self-talk while preventing loss of the beginning of utterances by another speaker.

Hearing aid 100*b* may set the release time when it is removed to be longer than the release time when it is put on (for example, time t1). By doing this, because hearing aid 100*b* makes the time for limiting the volume long, it is possible to switch the power supply off in sufficient time before feedback noise occurs.

It is possible, for example, from the length of the contact vibration noise to judge whether the hearing aid is being put on or removed. This is because, with the behind-the-ear type hearing aid 100*b*, ear tip 300 is fitted into the ear hole by feeling around for it, so that the length of duration of the vibration noise is usually longer when putting the hearing aid on than when removing it.

Audio limiter 142*b* of hearing aid 100*b*, as in Embodiment 3, may be applied to a hearing aid that identifies vibration noise based on vibration noise components extracted from three or more frequency bands. If more types of vibration noise might be input as the identification results, it is desirable that audio limiter 142*b* of hearing aid 100*b* performs more types of suppression processing.

Although, in the present embodiment, the audio limiter is disposed in the stage following the hearing aid processing section because of the simplicity of only one system being needed for applying limiting, the audio limiter may be disposed in the stage before the hearing aid processing section depending upon the purpose. In this case, it is possible to perform limiting with respect to the first collected sound signal and the second collected sound signal separately.

Embodiment 5

Embodiment 5 of the present invention is an example that is applied to a feedback noise canceller in the suppression processing section of Embodiment 2.

Figure 17:
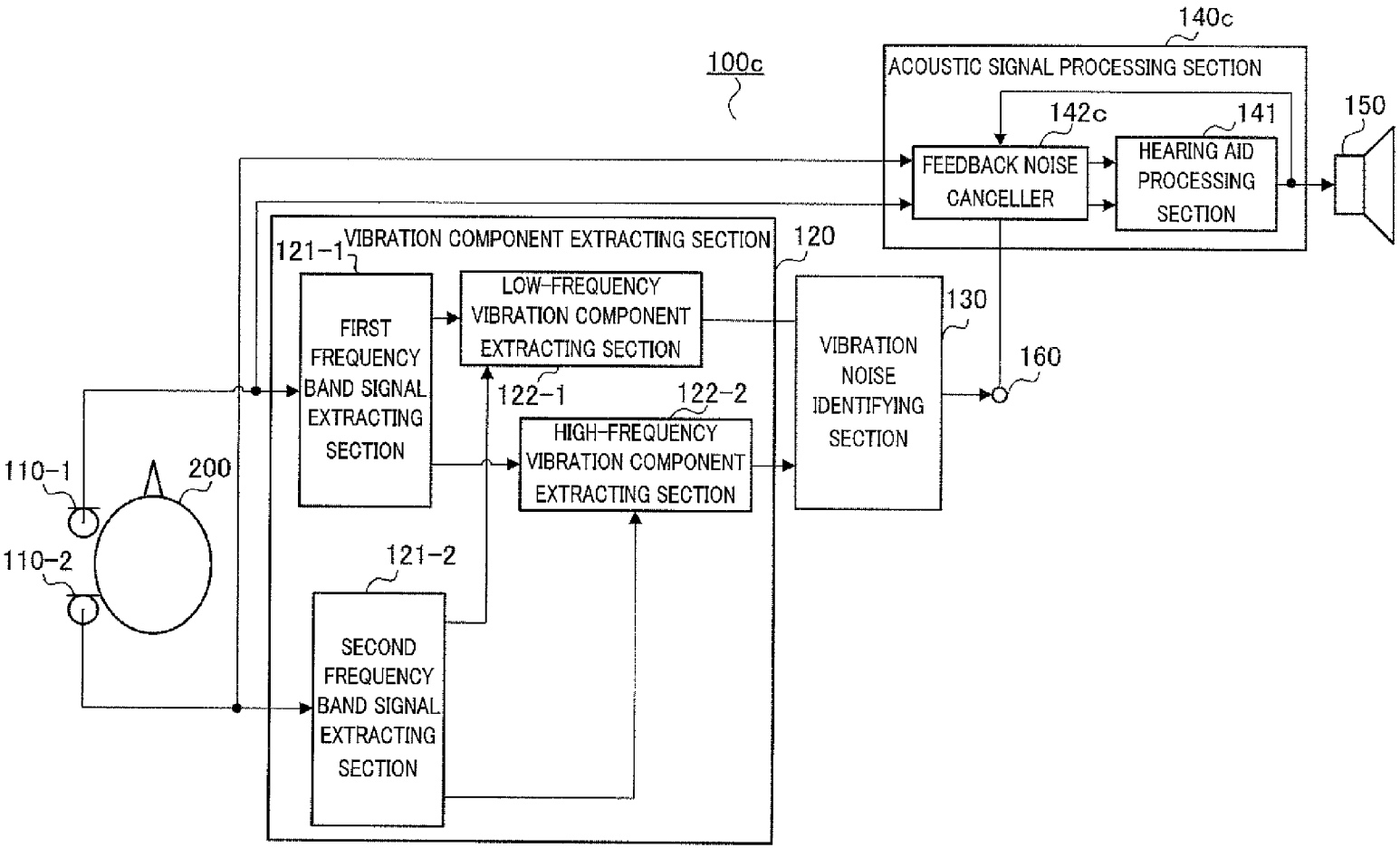
FIG. 17 is a block diagram showing an example of the configuration of a hearing aid according to Embodiment 5 of the present invention.

FIG. 17 is a block diagram showing an example of the configuration of a hearing aid according to Embodiment 5 of the present invention, and corresponds to FIG. 2 of Embodiment 2. The same reference signs are assigned to parts that are the same as parts in FIG. 2, and the descriptions thereof are omitted.

In FIG. 17, hearing aid 100*c* has acoustic signal processing section 140*c* instead of acoustic signal processing section 140 as shown in FIG. 2. Acoustic signal processing section 140*c* has feedback noise canceller 142*c*, as a specific example of suppression processing section 142, that is disposed in the stage before hearing aid processing section 141.

Feedback noise canceller 142*c* processes volume suppression of feedback noise by subtracting a pseudo-feedback noise signal from each of the first and second collected sound signals as prescribed processing for the above-described suppressing feedback noise. The pseudo-feedback noise signal is a signal that simulates a feedback noise signal generated between receiver 150 and microphones 110.

Feedback noise canceller 142*c* generates the pseudo-feedback noise signal based on a hearing aid processing output (acoustic signal) from hearing aid processing section 141. Feedback noise canceller 142*c* outputs to hearing aid processing section 141 first and second sound correcting signals that have been subjected to feedback noise volume suppression processing.

Figure 18:
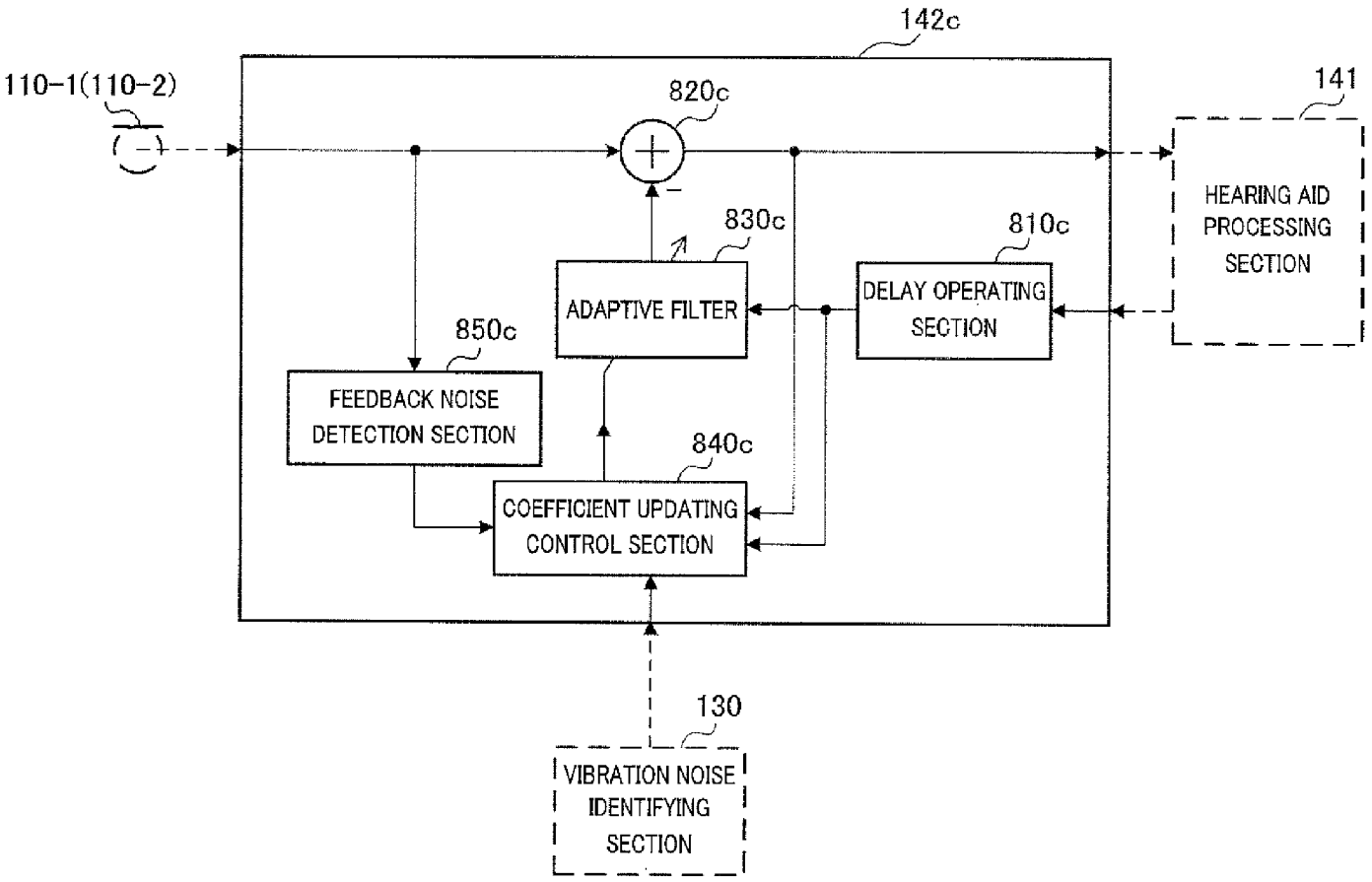
FIG. 18 is a block diagram showing an example of the configuration of a feedback noise canceller in Embodiment 5 of the present invention.

FIG. 18 is a block diagram showing an example of the configuration of feedback noise canceller 142*c*.

Feedback noise canceller 142*c* has, for example, a dual configuration, with one system for the first collected sound signal and one system for the second collected sound signal. Because these two systems have the same configuration, the configuration of only one will be described. As a convenience of description, FIG. 18 also illustrates the surrounding functional elements.

As shown in FIG. 18, feedback noise canceller 142*c* has delay operating section 810*c*, adder 820*c*, adaptive filter 830*c*, coefficient updating control section 840*c*, and feedback noise detection section 850*c*.

Delay operating section 810*c* outputs, as delayed hearing aid processing output to adaptive filter 830*c* and coefficient updating control section 840*c*, a signal that is delayed with respect to the hearing aid processing output (acoustic signal) from hearing aid processing section 141.

Adder 820*c* outputs a signal indicating the difference between the collected sound signal of microphones 110 and the pseudo-feedback noise signal of adaptive filter 830*c*, as a feedback noise canceller output signal, to hearing aid processing section 141 and coefficient updating control section 840*c*.

Adaptive filter 830*c* outputs, as a pseudo-feedback noise signal to adder 820*c*, a signal resulting from filtering of the delayed hearing aid processing output of the delay operating section 810*c* using filter coefficients output from coefficient updating control section 840*c*.

Coefficient updating control section 840*c* obtains the delayed hearing aid processing output of delay operating section 810*c*, the feedback noise canceller output of adder 820*c*, the identification result of vibration noise identifying section 130, and the feedback noise detection signal of feedback noise detection section 850*c*. Coefficient updating control section 840*c* updates the filter coefficients of adaptive filter 830*c* using the delayed hearing aid processing output, the feedback noise canceller output, the identification result, and the feedback noise detection signal.

Updating of the filter coefficients is done a speed in accordance with the step gain $\alpha$ ($0<\alpha\leq 1$) set by coefficient updating control section 840*c*.

Coefficient updating control section 840*c* controls parameters related to filter coefficient updating processing in accordance with the occurrence or non-occurrence of contact vibration noise. In this case, one example of controlling the speed of coefficient updating for the adaptive filter is shown.

Feedback noise detection section 850*c* monitors the collected sound signal of microphones 110, detects a feedback noise waveform, and outputs the detection result to coefficient updating control section 840*c*.

The above completes the description of the configuration of hearing aid 100*c*.

Next, the operation of hearing aid 100*c* will be described.

The operation of hearing aid 100*e* differs from the flowchart shown in FIG. 7 regarding Embodiment 2 only with regard to step S2200. Given this, the processing executed by hearing aid 100*c* at step S2200 of FIG. 7 (that is volume limiting processing) will be described.

Figure 19:
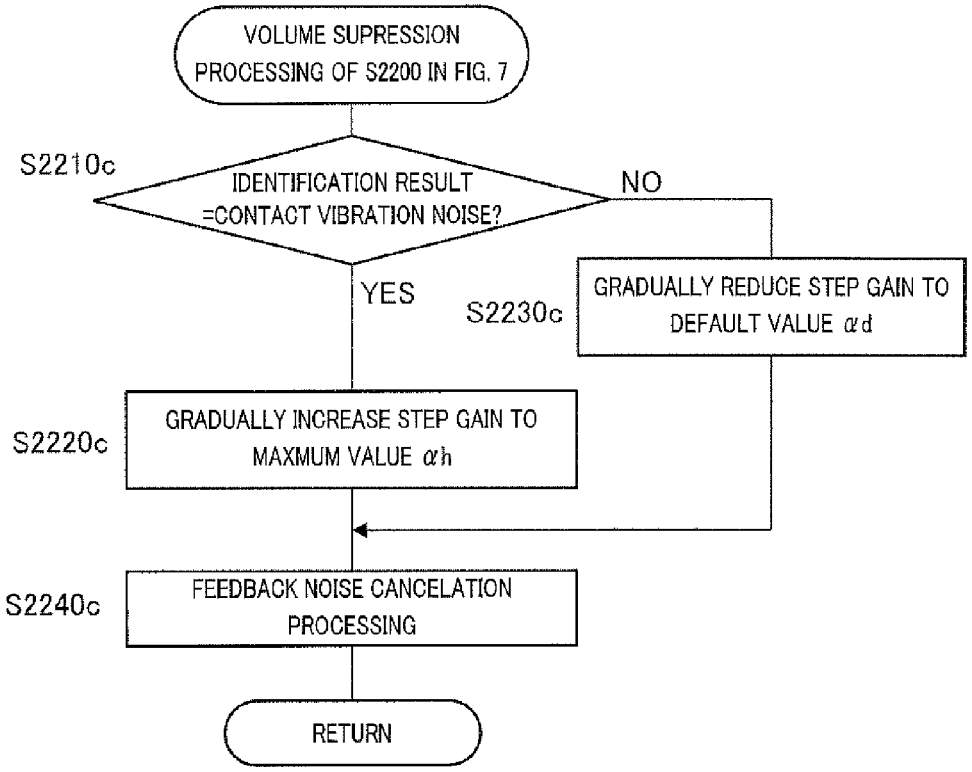
FIG. 19 is a flowchart showing an example of volume suppression control executed by the hearing aid according to Embodiment 5 of the present invention.

FIG. 19 is a flowchart showing an example of the volume limiting processing executed by hearing aid 100*c*.

First, at step S2210*c*, feedback noise canceller 142*c* judges whether or not the identification result is "contact vibration noise exists."

If feedback noise canceller 142*c* judges that the identification result is "contact vibration noise exists," (YES at S2210*c*), processing proceeds to step S2220*c*. If feedback noise canceller 142*c* judges that the identification result is not "contact vibration noise exists," (NO at S2210*c*), processing proceeds to step S2230*c*.

At step S2220*c*, feedback noise canceller 142*c* gradually increases the step gain $\alpha$ of filter coefficient updating up to a maximum value $\alpha h$ of step gain that is higher than the default value $\alpha d$ of the step gain $\alpha$, and then maintains it at $\alpha h$. That is, feedback noise canceller 142*c* updates filter coefficients at a high speed.

Specifically, coefficient updating control section 840*c* of feedback noise canceller 142*c*, for example, updates the step gain $\alpha$ gradually to the maximum value of $\alpha h$ using the following Equation 4. In Equation 4, n represents the current time and $\gamma$ is a fixed value that is sufficiently smaller than 1. That is, $\alpha(n)$ is the step gain that should currently be set, and $\alpha(n-1)$ is the step gain set at the immediately previous time. Also, $\alpha var$ is a variable for the storage of the target value of the step gain $\alpha$ (in this case, the maximum value $\alpha h$).

[4]

$$\alpha(n)=\gamma\cdot\alpha var+(1-\gamma)\cdot\alpha(n-1) \quad \text{(Equation 4)}$$

At step S2230*c*, feedback noise canceller 142*c* decreases the step gain $\alpha$ of the filter coefficient updating gradually down to the default value $\alpha d$ of the step gain $\alpha$, or maintains the step gain at the default value $\alpha d$. That is, feedback noise canceller 142*c* updates the filter coefficients at the usual speed.

Specifically, coefficient updating control section 840 of feedback noise canceller 142*c* updates the step gain $\alpha var$ gradually to approach the default value $\alpha d$ using the above-noted Equation 4 in which the default value $\alpha d$ is stored in $\alpha var$.

Then, at step S2240*c*, feedback noise canceller 142*c* performs feedback noise cancelation processing to suppress the feedback noise components of the first and second collected sound signals, so as to obtain a feedback noise cancelation output.

An example of the specific details of feedback noise cancelation processing will be described.

Specifically, by delay operating section 810*c*, feedback noise canceller 142*c* delays the acoustic signal after hearing aid processing by an amount that satisfies the causality. After that, feedback noise canceller 142*c*, by adaptive filter 830*c*, applies filtering and generates a pseudo-feedback noise signal.

Feedback noise canceller 142*c*, by adder 820*c*, takes the differences between the first and second collected sound signals and the respective pseudo-feedback noise signals, and outputs an acoustic signal from which feedback noise has been canceled.

Feedback noise canceller 142*c*, updates the filter coefficients of adaptive filter 830*c*, for example, using NLMS (Normalized Least Mean Square method) by the set step gain.

If NLMS is used, feedback noise canceller 142*c*, for example, updates the coefficient vector w of the adaptive filter coefficients using the following Equation 5. In Equation 5, x is the output signal vector of the feedback noise canceller, e is the canceller output sample, and $\beta$ is a minute coefficient to prevent a zero denominator.

(Equation 5)

$$w(n+1) = w(n) + \frac{\alpha}{x(n)^T x(n) + \beta} e(n)x(n) \quad [5]$$

The step gain $\alpha$, as described above, becomes a large value when contact vibration noise is detected and, as a result, the speed of convergence of the coefficient vector becomes high. By doing this, the pseudo-feedback noise signal tracks closely to sudden changes in the acoustic system. Therefore, feedback noise canceller 142*c*, by controlling the above-described step gain and performing feedback noise cancelation processing, can effectively suppress (cancel) the occurrence of feedback noise caused by variation in the acoustic system when hearing aid 100*c* is put on or removed.

Also, the step gain $\alpha$, as described above, becomes a low value when contact vibration noise is not detected and, as a result, the speed of convergence becomes low. Because of this, hearing aid 100*c* can achieve the above-described feedback noise suppression, while minimizing the influence on the intended acoustic signal.

When feedback noise canceller 142*c* completes the feedback noise cancelation processing, return is made to the processing of FIG. 7.

In this manner, hearing aid 100*c* of the present embodiment adopts feedback noise canceller 142*c*, which performs feedback noise cancelation processing on the hearing aid processing output (acoustic signal) of hearing aid processing section 141.

By doing this, hearing aid 100*c* of the present embodiment can cancel feedback noise in accordance with the identification result of the vibration noise. That is, hearing aid 100*c* of the present embodiment can be used normally when contact vibration noise is not detected, and can effectively suppress feedback noise when contact vibration noise is detected. In other words, hearing aid 100*c* of the present embodiment can quickly track feedback noise when it is put on or removed.

Hearing aid 100*c* of the present embodiment achieves feedback noise cancelation processing capable of providing a stable amount of volume limiting when there is little variation in the acoustic system.

Although the description of the present embodiment has been for an example of controlling parameters for updating the coefficients of an adaptive filter, the application of the detection result is not restricted in this manner. The detection of contact vibration noise may be used for limiting processing such as reducing the gain of microphone 110-1 (110-2), or applied to control of various parameters for controlling feedback noise.

Hearing aid 100*c* may use the duration time of vibration noise and judge whether the hearing aid is being put on or removed, setting the step gain when the hearing aid is being put on to be higher than when being removed or making the speed of controlling to reduce the step gain slower. By doing this, hearing aid 100*c* can establish stability after it is put on, while most effectively limiting feedback noise occurring immediately after removing it from the ear.

Although there is no particular description regarding control using self-talk noise that is secondarily detected in Embodiment 1 to Embodiment 5, with the exception of Embodiment 4, in those embodiments as well, similar to Embodiment 4, this may be used.

In the above case, it is desirable that the hearing aid controls the volume so that shallow suppression is performed compared with feedback noise suppression when contact vibration noise is detected, and so that control of limiting and release from limiting are performed quickly. By doing this, the hearing aid can adjust the volume to a level that is not audibly annoying and prevent the loss of initial utterances of another person's voice.

In a hearing aid worn on both ears, the additional hearing aid may be synchronized with the hearing aid on the opposite ear in performing feedback noise suppression. That is, in a hearing aid for use on both ears, of the two hearing aids, when vibration noise is detected in at least one thereof, not only that hearing aid, but also the other hearing aid may start prescribed processing in response to detection of the vibration noise.

In the above case, it is necessary to have an additional communication section that communicates with the other hearing aid. Additionally, when vibration noise occurs it is necessary for the vibration noise identifying section to use the communication section to transmit information to that effect to the other hearing aid. Upon transmission from the other hearing aid of information indicating the judgment that contact vibration noise has occurred, the acoustic signal control section needs to use the communication section to receive the information and perform the same processing as when contact vibration noise occurs in its own hearing aid.

In the case of hearing aids for use on both ears, the user usually puts on one hearing aid immediately after putting on the other hearing aid. Therefore, the hearing aid put on afterward can avoid the occurrence of feedback noise in advance, thereby enabling more reliable prevention of feedback noise. Also, in such hearing aids, it is possible to alleviate an unnatural feeling by a difference in the hearing between the left and right ears.

Although in the above-described embodiments prescribed processing responsive to the occurrence or non-occurrence of contact vibration noise is processing for feedback noise suppression, this is not a restriction. The vibration detection method of the present invention is not limited in application to hearing aids, but can also be applied to various acoustic devices having a speaker for emitting sound and a plurality of microphones, for example, application to a headset.

The disclosure of Japanese Patent Application No. 2011-087399, filed on Apr. 11, 2011, including the specification, drawings, and abstract, is incorporated herein by reference in its entirety.

The hearing aid and vibration detection method according to the present invention is suitable for use in a hearing aid and vibration detection method capable of detecting contact vibration noise from a collected sound signal.

REFERENCE SIGNS LIST

100, 100*a*, 100*b*, 100*c* Hearing aid
110-1, 110-2 Microphone
120, 120*a* Vibration component extracting section
121-1, 121*a*-1 First frequency band signal extracting section
121-1, 121*a*-2 Second frequency band signal extracting section
122-1 Low-frequency vibration component extracting section
122-2 High-frequency vibration component extracting section
122*a*-1 to 122*a*-N First to N-th vibration component extracting section
130, 130*a* Vibration noise identifying section
140, 140*b*, 140*e* Acoustic signal processing section
141 Hearing aid processing section
142 Suppression processing section
142*b* Audio limiter
142*c* Feedback noise canceller
150 Receiver
160 Output section
310 Hearing aid main unit
320 Acoustic tube
330 Ear tip
410-1 Lowpass filter
410-2 Highpass filter
510-1 First square value calculating section
510-2 Second square value calculating section
520-1 First smoothing section
520-2 Second smoothing section
530 Variable multiplier
540 Adder
550 Absolute value calculating section
710*a*-1 to 710*a*-N First to N-th bandpass filter
720*a* Analysis window section
730*a* FFT section

810*c* Delay operating section
820*c* Adder
830*c* Adaptive filter
840*c* Coefficient updating control section
850*c* Feedback noise detection section

The invention claimed is:

1. A hearing aid comprising:
two microphones;
a receiver;
a hardware processor;
a non-transitory memory storing a control program, the control program being executed by the hardware processor so as to:
extract, from collected sound signals obtained by each of the two microphones, non-correlated components between the two collected sound signals as frequency band specific vibration components;
judge, based on the frequency band specific vibration components extracted whether or not a contact vibration noise has occurred; and
perform, when performing hearing aid processing of the two collected sound signals and generating an acoustic signal, processing for the acoustic signal in accordance with the occurrence or non-occurrence of the contact vibration noise; and
the receiver converts the acoustic signal to a sound.

2. The hearing aid according to claim 1, wherein:
when only low-frequency band vibration components of the frequency band specific vibration components are detected, the vibration components are distinguished as a self-talk noise from the contact vibration noise.

3. The hearing aid according to claim 1, wherein:
a condition that a relative level of high-frequency band vibration components is high is used with respect to a level of low-frequency band vibration components to judge that the contact vibration noise has occurred.

4. The hearing aid according to claim 1, wherein:
the control program is executed by the hardware processor so as to:
extract low-frequency band signals and high-frequency band signals from each of the two collected sound signals; and
extract a level of low-frequency band vibration components from the two low-frequency band signals and a level of high-frequency band vibration components from the two high-frequency band signals.

5. The hearing aid according to claim 4, wherein:
using the condition that a ratio of the level of the high-frequency band vibration components with respect to the level of the low-frequency band vibration components exceeds a prescribed threshold, it is judged that the contact vibration noise has occurred.

6. The hearing aid according to claim 2, wherein:
using the condition that a spectrum pattern of the vibration components is more similar to a spectrum pattern of the vibration components of the contact vibration noise than to a spectrum pattern of vibration components of a self-talk noise, it is judged that the contact vibration noise has occurred.

7. The hearing aid according to claim 2, wherein:
using the conditions of the level of the vibration components being high and the non-occurrence of the contact vibration noise, it is judged that a self-talk vibration noise has occurred; and
the control program executed by the hardware processor further controls a volume of the acoustic signal in accordance with the occurrence or non-occurrence of the contact vibration noise, and the occurrence or non-occurrence of the self-talk vibration noise.

8. The hearing aid according to claim 2, wherein:
the control program executed by the hardware processor further suppresses feedback noise of the acoustic signal using an adaptive filter and that controls a parameter relative to feedback noise suppression in accordance with the occurrence or non-occurrence of the contact vibration noise.

9. The hearing aid according to claim 2, wherein:
the control program is further executed by the hardware processor so as to communicate with another hearing aid that is placed in the opposite-side ear of two ears, and the control program executed by the hardware processor further:
transmits to the other hearing aid information indicating the occurrence when judging that the contact vibration noise has occurred;
when information indicating the judgment of occurrence of the contact vibration noise is transmitted from the other hearing aid, receives the information using the communication section; and
performs the same processing as when judging that the contact vibration noise has occurred.

10. A method of detecting vibration in a hearing aid, the hearing aid including two microphones, a receiver, a hardware processor, and a non-transitory memory storing a control program, the control program being executed by the hardware processor so as to execute the method comprising:
extracting from collected sound signals obtained by the two microphones non-correlated components between the two collected sound signals as frequency band specific vibration components,
judging, based on the extracted frequency band specific vibration components, whether or not a contact vibration noise has occurred, and
when performing hearing aid processing of the two collected sound signals and generating an acoustic signal, performing processing of the acoustic signal in accordance with the occurrence or non-occurrence of the contact vibration noise.

* * * * *